US008000622B2

(12) United States Patent
Ishizaki et al.

(10) Patent No.: US 8,000,622 B2
(45) Date of Patent: Aug. 16, 2011

(54) MOVING BODY CONTROLLING DEVICE, INTERMEDIATE TRANSFERRING DEVICE, AND IMAGE FORMING APPARATUS HAVING THE SAME

(75) Inventors: Yuusuke Ishizaki, Kanagawa (JP); Takahisa Koike, Tokyo (JP); Koji Kiryu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/659,715

(22) Filed: Mar. 18, 2010

(65) Prior Publication Data

US 2010/0239293 A1 Sep. 23, 2010

(30) Foreign Application Priority Data

Mar. 18, 2009 (JP) ..... 2009-065670
Feb. 8, 2010 (JP) ..... 2010-025772

(51) Int. Cl.
*G03G 15/16* (2006.01)

(52) U.S. Cl. ..... 399/66; 318/625

(58) Field of Classification Search ..... 399/38, 399/66, 67, 116, 162, 167; 318/625
See application file for complete search history.

(56) References Cited

U.S. PATENT DOCUMENTS

2002/0159792 A1* 10/2002 Matsumoto ..... 399/167
2005/0084293 A1* 4/2005 Fukuchi et al. ..... 399/167
2006/0140685 A1* 6/2006 Muroi ..... 399/301
2008/0089714 A1* 4/2008 Dan ..... 399/167
2008/0298856 A1 12/2008 Koike

FOREIGN PATENT DOCUMENTS

JP 11-024507 1/1999
JP 2005-338703 12/2005

* cited by examiner

*Primary Examiner* — David P Porta
*Assistant Examiner* — Marcus H Taningco
(74) *Attorney, Agent, or Firm* — Harness, Dickey & Pierce, P.L.C.

(57) ABSTRACT

A disclosed moving body controlling device includes a first moving body driven by a first motor that is controlled by a first control unit, a second moving body driven by a second motor that is controlled by a second control unit and affecting movement of the first moving body, a memory unit storing a relationship between the second motor rotational speed and an indicating value for driving the first and second motors when the second control unit changes the second motor rotational speed while the first control unit controls a first motor rotational speed to cause a first rotational body surface speed to be a predetermined speed in a mode of setting a second motor target rotational speed, whereby a reference point at which the surface speed starts to exceed the predetermined speed is detected, and based on the reference point the second motor target rotational speed is set.

8 Claims, 13 Drawing Sheets

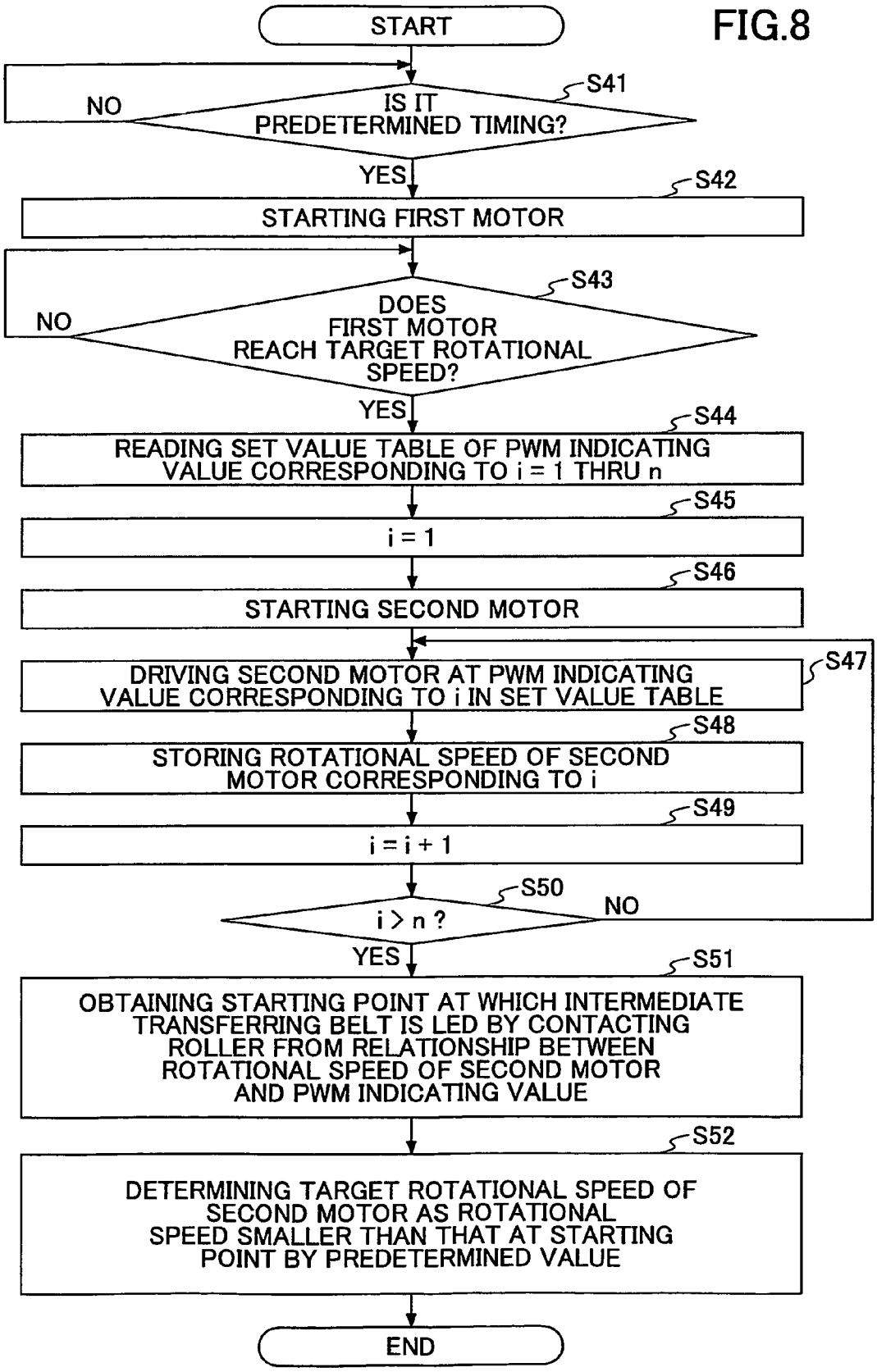
FIG.8
START
S41
IS IT PREDETERMINED TIMING?
NO
YES
S42
STARTING FIRST MOTOR
S43
DOES FIRST MOTOR REACH TARGET ROTATIONAL SPEED?
NO
YES
S44
READING SET VALUE TABLE OF PWM INDICATING VALUE CORRESPONDING TO i = 1 THRU n
S45
i = 1
S46
STARTING SECOND MOTOR
S47
DRIVING SECOND MOTOR AT PWM INDICATING VALUE CORRESPONDING TO i IN SET VALUE TABLE
S48
STORING ROTATIONAL SPEED OF SECOND MOTOR CORRESPONDING TO i
S49
i = i + 1
S50
i > n ?
NO
YES
S51
OBTAINING STARTING POINT AT WHICH INTERMEDIATE TRANSFERRING BELT IS LED BY CONTACTING ROLLER FROM RELATIONSHIP BETWEEN ROTATIONAL SPEED OF SECOND MOTOR AND PWM INDICATING VALUE
S52
DETERMINING TARGET ROTATIONAL SPEED OF SECOND MOTOR AS ROTATIONAL SPEED SMALLER THAN THAT AT STARTING POINT BY PREDETERMINED VALUE
END

MOVING BODY CONTROLLING DEVICE, INTERMEDIATE TRANSFERRING DEVICE, AND IMAGE FORMING APPARATUS HAVING THE SAME

BACKGROUND OF THE INVENTION

1. Field of the Invention

The present invention generally relates to a moving body controlling device, an intermediate transferring device and an image forming apparatus having the intermediate transferring device.

2. Description of the Related Art

Image forming apparatuses such as copiers, printers and facsimile machines typically have an image forming device including a photoreceptor drum for forming an image, an intermediate transferring device for transferring the image formed by the image forming device to a recording medium and a fixing device for fixing the transferred image.

Further, the image forming apparatuses ordinarily include a moving body controlling device for carrying recording media (which may be ordinarily referred to as a recording paper) into an intermediate transferring device and a fixing device and carrying the recording media out of the intermediate transferring device and the fixing device.

Ordinarily, the intermediate transferring devices are formed by combining an endless belt suspended and rotated by plural rollers and a contacting roller that is in contact with the endless belt.

The intermediate transferring devices transfer toner images transferred from the image forming devices to the belts while holding recording papers by nipping the recording papers with a contacting portion (nipping portion).

Since the intermediate transferring devices are a device for driving a belt, the intermediate transferring devices may be used not only as image forming apparatuses but also as moving body controlling devices for carrying various sheet-like materials. In case of intermediate transferring devices for color image forming apparatuses of electrophotographic systems, belts are used as recording media for primary transfer and have functions of secondary transfer to recording papers. In such intermediate transferring devices, when there are variations in rotational speeds of the belts, deformation or color shift may occur on images transferred to the recording papers. Therefore, it is necessary to accurately control carrying speeds of the intermediate transferring devices, i.e. surface speeds of the belts, to avoid the deformation and the color shift.

A relationship between an intermediate transferring medium of an image forming apparatus and a contacting roller (a secondary transferring roller) is described next. Conventionally, an encoder is installed in a belt driving shaft (a driving roller shaft) as a technique of controlling the intermediate transferring medium. Signals from the encoder is fed back to a first control unit for driving the belt to thereby control the rotational speed of the first motor. Thus, the speed of the intermediate transferring medium can be controlled. Further, there is a conventional technique that a scale is provided on a surface of the intermediate transferring medium to enable a sensor to read the scale. Thus, the speed of the intermediate transferring medium is measured. The measured speed information is used to control the driving speed of the first motor. Resultantly, the speed of the belt can be more accurately controlled.

At this time, the secondary transferring roller in contact with the intermediate transferring medium is led by the intermediate transferring medium or is driven and rotated by a second motor. When the secondary transferring roller is rotated by the second motor, a control target rotational speed of the second motor is determined so that the surface speed of the intermediate transferring medium is the same as the surface speed of the secondary transferring roller.

Patent Document 1 discloses an image forming apparatus having an intermediate transferring device that does not cause deformation and color shift of images when images are copied to recording papers.

In the image forming apparatus, a speed profile of the intermediate transferring medium is measured, a speed profile of a secondary transferring roller in contact with the intermediate transferring medium is controlled to have a profile of speed variation reverse to the profile of speed variation in the intermediate transferring medium. Therefore, it becomes possible to prevent deformation of secondary transferred images on recording papers, which are transferred from the intermediate transferring medium.

In this case, recording papers which undergo the secondary transfer are carried in conformity with the profile of speed variation of the secondary transferring roller. Meanwhile, the speed of the intermediate transferring medium at a nipping portion is set substantially the same as the recording papers. Therefore, a carrying speed of the recording papers measured by a measuring unit and a carrying speed of the recording papers at the nipping portion may differ. In this case, it is rarely problematic if the profile of speed variation of the intermediate transferring medium has a small amplitude or a waveform of an extremely long period. However, if the intermediate transferring medium does not have the small amplitude and the waveform of the extremely long period, slack or stretch may occur. As a result, images may be deformed.

When the secondary transferring roller is driven by a second motor, the outer diameter of the secondary transferring roller may be increased by temperature rise or the like. As a result, the surface speed of the secondary transferring roller may become higher than the surface speed of an intermediate transferring medium. Therefore, there occurs a problem that the rotational speed of the intermediate transferring medium increases because the intermediate transferring medium is led by the secondary transferring roller thereby being forced to be driven. In ordinary brushless motors, the rotational speed is adjusted by a pulse width modulation (PWM) signal and cannot undertake decelerating or reversing control. Therefore, it is not possible to reduce the speed when the rotational speed becomes higher than a target value due to an extraneous effect. Therefore, there is a case where the rotational speed becomes higher than the target value even though an instruction value of PWM for the first motor is minimized to be an instruction value of the rotational speed due to leading by the secondary transferring roller. In this case, it is not possible to control the speed of the intermediate transferring medium to be constant. Thus, there are problems that images are not stably output, and a control unit of an image forming apparatus detects abnormality in the rotational speed to thereby stop the motor. Resultantly, the image forming apparatus may be stopped.

Not only in the intermediate transferring medium, when there are a moving body (a carrying body or a rotating body) and another moving body (another carrying body or rotating body) affecting the rotation of the moving body, the moving body is sometimes lead by the other moving body, and the other moving body including a moving body including a moving body is sometimes lead by the moving body. Then, the problems identical to or similar to those described above may occur.

Patent Document 1: Japanese Laid-Open Patent Application No. 2005-338703

SUMMARY OF THE INVENTION

Accordingly, embodiments of the present invention may provide a novel and useful moving body controlling device, intermediate transferring device and an image forming apparatus which constantly maintains a surface speed of an intermediate transferring medium and a carrying speed of recording media even when operating conditions or environmental conditions change, solving one or more of the problems discussed above.

One aspect of the embodiments of the present invention may be to provide a moving body controlling device including a first moving body configured to be rotated by a first motor, a second moving body configured to affect movement of the first moving body, a second motor configured to rotate a second moving body, a surface speed detecting unit configured to detect a surface speed of the first moving body, a first control unit configured to control rotation of the first motor, a second control unit configured to control rotation of the second motor, a memory unit configured to store a relationship between the rotational speed of the second motor and an indicating value for driving at least one of the first motor and the second motor when the second control unit changes the rotational speed of the second motor while the first control unit controls a rotational speed of the first motor to cause the surface speed detected by the surface speed detecting unit to be a predetermined speed, when the moving body controlling device is in a mode of setting the target rotational speed of the second motor, a reference point detecting unit configured to detect based on the relationship stored in the memory unit a reference point of the rotational speed of the second motor at which the surface speed of the first moving body starts to exceed the predetermined speed, when the moving body controlling device is in a mode of setting in the mode of setting the target rotational speed of the second motor, and a setting unit configured to set the target rotational speed of the second motor based on the reference point detected by the reference point detecting unit, when the moving body controlling device is in the mode of setting the target rotational speed of the second motor, whereby when the moving body controlling device is not in the mode of setting the target rotational speed of the second motor, the first control unit controls the rotational speed of the first motor to cause the surface speed detected by the surface speed detecting unit to be the predetermined speed, and the second control unit controls the second motor to rotate at the target rotational speed.

Additional objects and advantages of the embodiments will be set forth in part in the description which follows, and in part will be obvious from the description, or may be learned by practice of the invention. Objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

FIG. 8 is a flowchart (3) of a setup procedure of a target rotational speed of the second motor.

DETAILED DESCRIPTION OF THE PREFERRED EMBODIMENTS

A description is given below, with reference to FIG. 1 through FIG. 13 of embodiments of the present invention.

Hereinafter, reference signs typically designate as follows:

1: intermediate transferring medium (first or second moving body);
2: surface speed detecting unit (scale sensor);
3: first motor (intermediate transferring motor);
4: driving roller (first or second moving body);
4*a*: driving roller encoder;
5: second motor (contacting roller driving motor);
5*a*: second motor encoder;
6: contacting roller (first or second moving body);
7: motor control unit;
7*a*: load indicating value measuring unit;
8: rotational speed detecting unit (secondary transferring roller encoder);
9: contacting portion (nipping portion);
10: image forming apparatus;
11: paper supplying roller;
12: intermediate transferring device (transferring device);
13: photoreceptor (image holding body) (first or second moving body);
14: image developing unit;
15: exposure unit;
16: charging unit;
17: fixing device;
18: carrying belt;
19: contacting roller (first or second moving body);
21: main control unit;
22: control CPU;
23: memory;
24: operation unit.
101: driven roller (first or second moving body); and
102: driven roller (first or second moving body).

Embodiments of the intermediate transferring device are described next. The intermediate transferring device, which is also called a moving body controlling device or a belt driving device, of the embodiment transfers a toner image on an image holding body as a photoreceptor with an intermediate transferring belt, which is a first moving body as an intermediate transferring medium, and a second moving body as a contacting roller, which is also called a secondary transferring roller.

Figure 1:
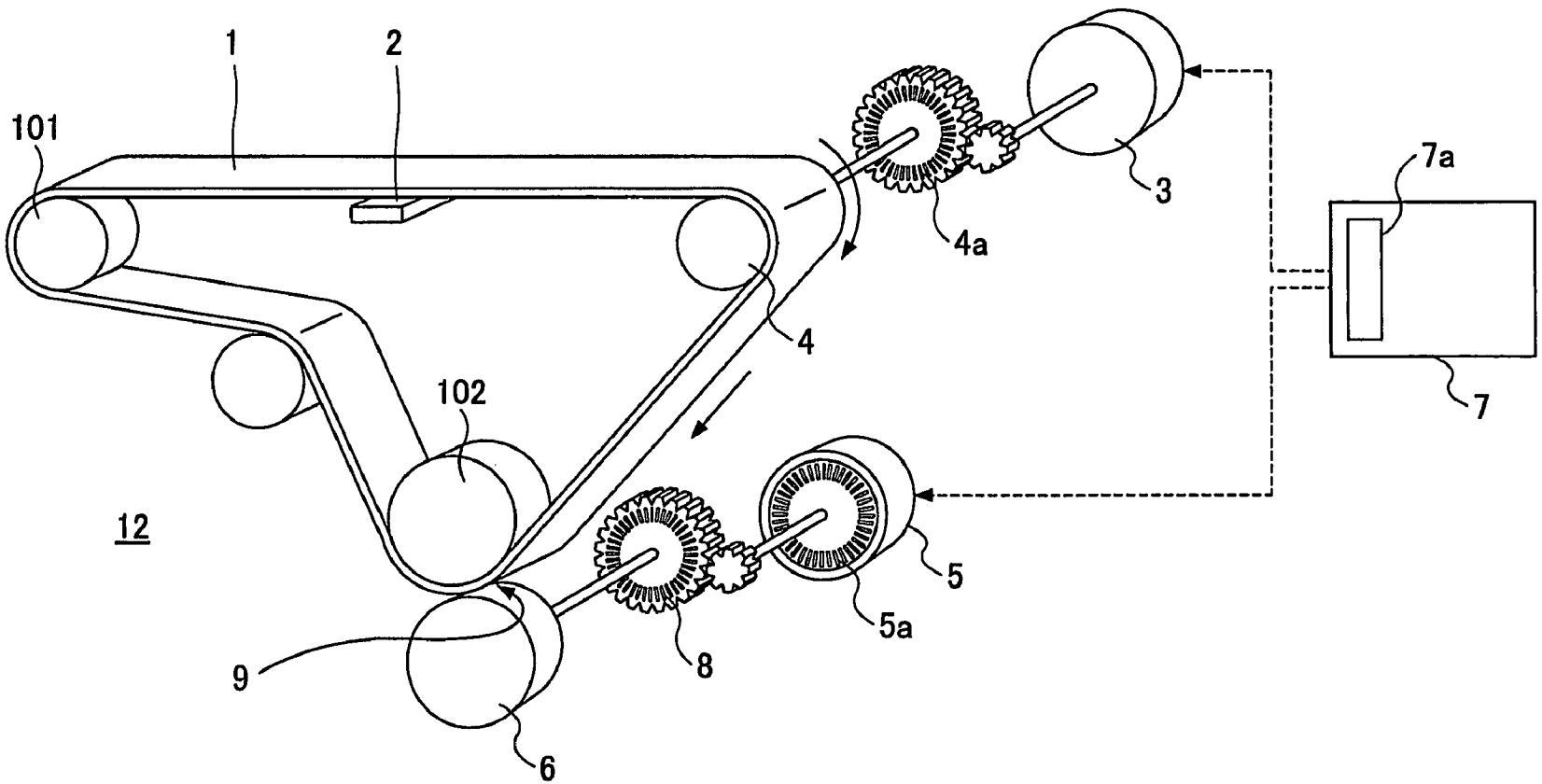
FIG. 1 is a functional block diagram of an information processing apparatus.

FIG. 1 schematically illustrates an intermediate transferring device 12 of Embodiment 1 of the present invention. The intermediate transferring device 12 includes a first motor (an intermediate transferring motor or a belt driving motor) 3, a driving roller encoder 4*a*, a driving roller 4 driven by the first motor 3 and an intermediate transferring medium 1 which is endless and suspended by 3 (three) driven rollers 4, 101 and 102. Scale marking is provided in the intermediate transferring medium 1. The surface speed of the belt is measured by a surface speed detecting unit (scale sensor) 2. A contacting roller (secondary transferring roller) 6 which is in contact with the intermediate transferring medium 1 is driven by a second motor (contacting roller driving motor) 5. The contacting roller (secondary transferring roller) 6 has a secondary transferring roller encoder 8, and the second motor 5 has a second motor encoder 5*a* to enable measuring rotational speeds of the contacting roller 6 and the second motor 5. The intermediate transferring device 12 includes a motor control unit 7 that controls the first motor 3 and the second motor 5. Hereinafter, a part of the motor control unit 7 that controls the first motor 3 is referred to as a first control unit, and a part of the motor control unit 7 that controls the second motor 5 is referred to as a first control unit. Further, the motor control unit 7 includes a load indicating value measuring unit 7*a*. The load indicating value measuring unit 7*a* measures load current values which indicates a load indicating value, including an electric current value and a pulse width modulation (PWM) indicating value, of at least one of the first motor 3 and the second motor 5 or both of the first motor 3 and the second motor 5.

Figure 2:
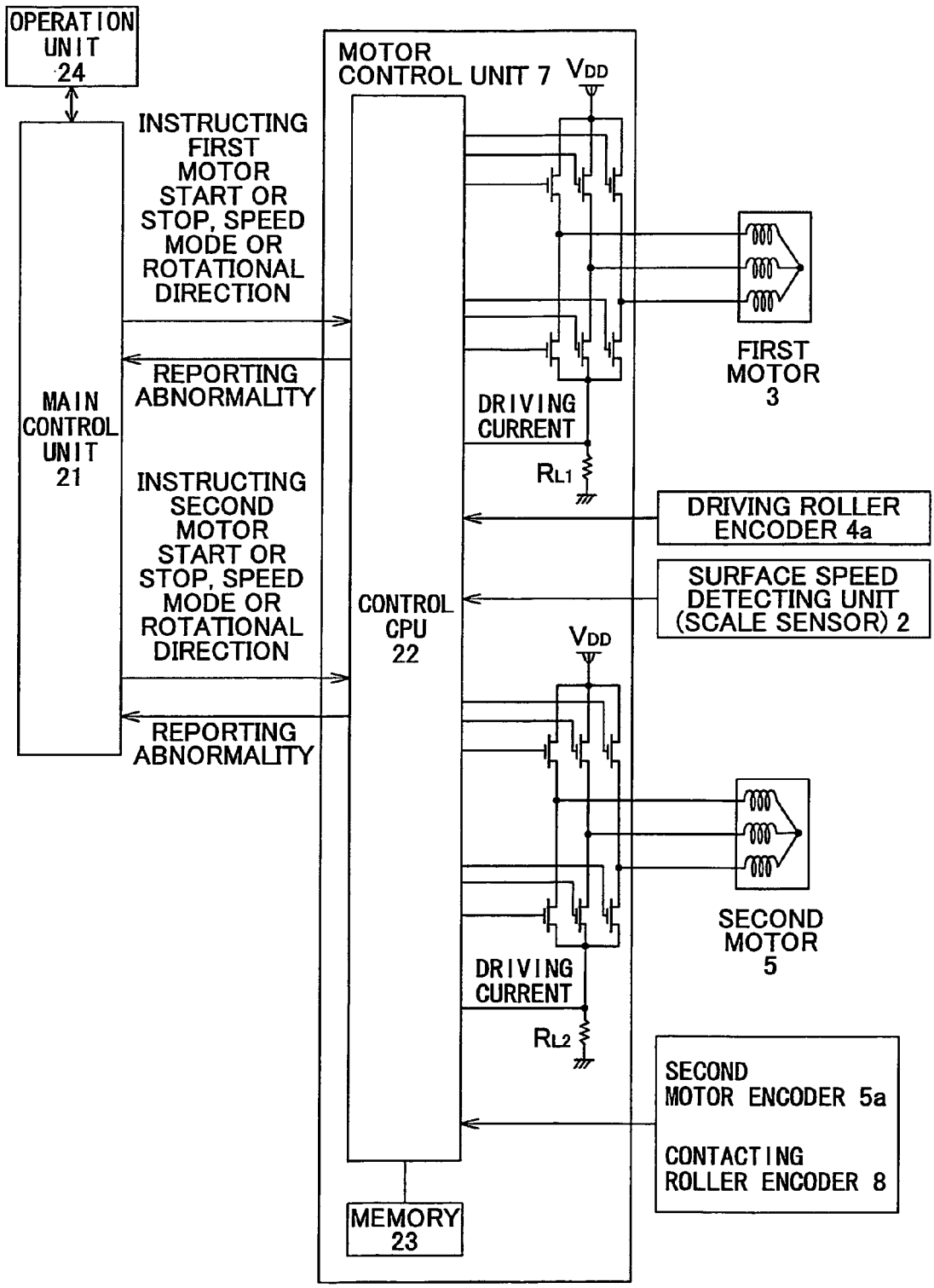
FIG. 2 is a block chart illustrating operations of a control unit for a first motor and a second motor of an intermediate transferring device.

FIG. 2 is a block chart illustrating operations of the motor control unit 7 for the first motor 3 and the second motor 5 of an intermediate transferring device of Embodiment 1. Referring to FIG. 2, a control CPU 22 is installed in the motor control unit 7. The motor control unit 7 measures driving current values of the first motor 3 and the second motor 5. The motor control unit 7 receives instruction from a main control unit 21 of the image forming apparatus, and controls rotational speeds of the first motor 3 and the second motor 5 according to driving electric currents or PWM indicating values of the first motor 3 and the second motor 5 or the like.

The main control unit 21 may include a memory unit, a reference point detecting unit and a setting unit described below.

Further, the motor control unit 7 collects and calculates rotational speed information from the driving roller encoder 4*a* of the driving roller 4 and the surface speed detecting unit (scale sensor) 2, rotational speed information from the second motor encoder 5*a* and the secondary transferring roller encoder 8, and electric current values of the first motor 3 and the second motor 5 for controlling the rotational speeds of the first motor 3 and the second motor 5. Further, the motor control unit 7 stores the collected data and the calculated data in a memory 23, a memory unit included in the main control unit 21 or the like when necessary, and reports information such as abnormality of the intermediate transferring device to the main control unit 21. The main control unit 21 is connected to an operation unit 24. The motor control unit 7 may be controlled by an operator when the operator operates the main control unit 21 via the operation unit 24.

Referring back to FIG. 1, the operation of the intermediate transferring device is described. The intermediate transferring medium 1 and the contacting roller 6 mutually interact by friction force at a contacting portion between the intermediate transferring medium 1 and the secondary transferring roller 6. One of the intermediate transferring medium 1 and the contacting roller 6 having a speed slower than the other one is led by the other one, and trails the other one. This leading and trailing relationship occurs whenever a sheet of recording paper is carried with or without the sheet being nipped by the nipping portion 9. Therefore, the intermediate transferring device 12 is operated while one of the intermediate transferring medium 1 and contacting roller 6 is led and pulled by the driving force of the other one when the one is rotated in an electrically shutdown state or with small driving force. Then, the motor rotated in the electrically shutdown state or with the small driving force is rotated under the leading and trailing relationship at a rotational speed corresponding to the motor which is driven with a larger force.

Even when the leading and trailing relationship does not exist, the driving forces causing electric current values or the like of the first motor 3 and the second motor 5 mutually interact to thereby change the driving force when the intermediate transferring medium 1 or the contacting roller 6 is controlled to rotate at a predetermined speed. For example, when the driving current to the first motor 3 is controlled to cause the first motor 3 to rotate at a predetermined speed, and the rotational speed of the second motor 5 is adjusted, the driving current of the first motor 3 changes due to the change of the rotational speed of the first motor 3.

Figure 3:
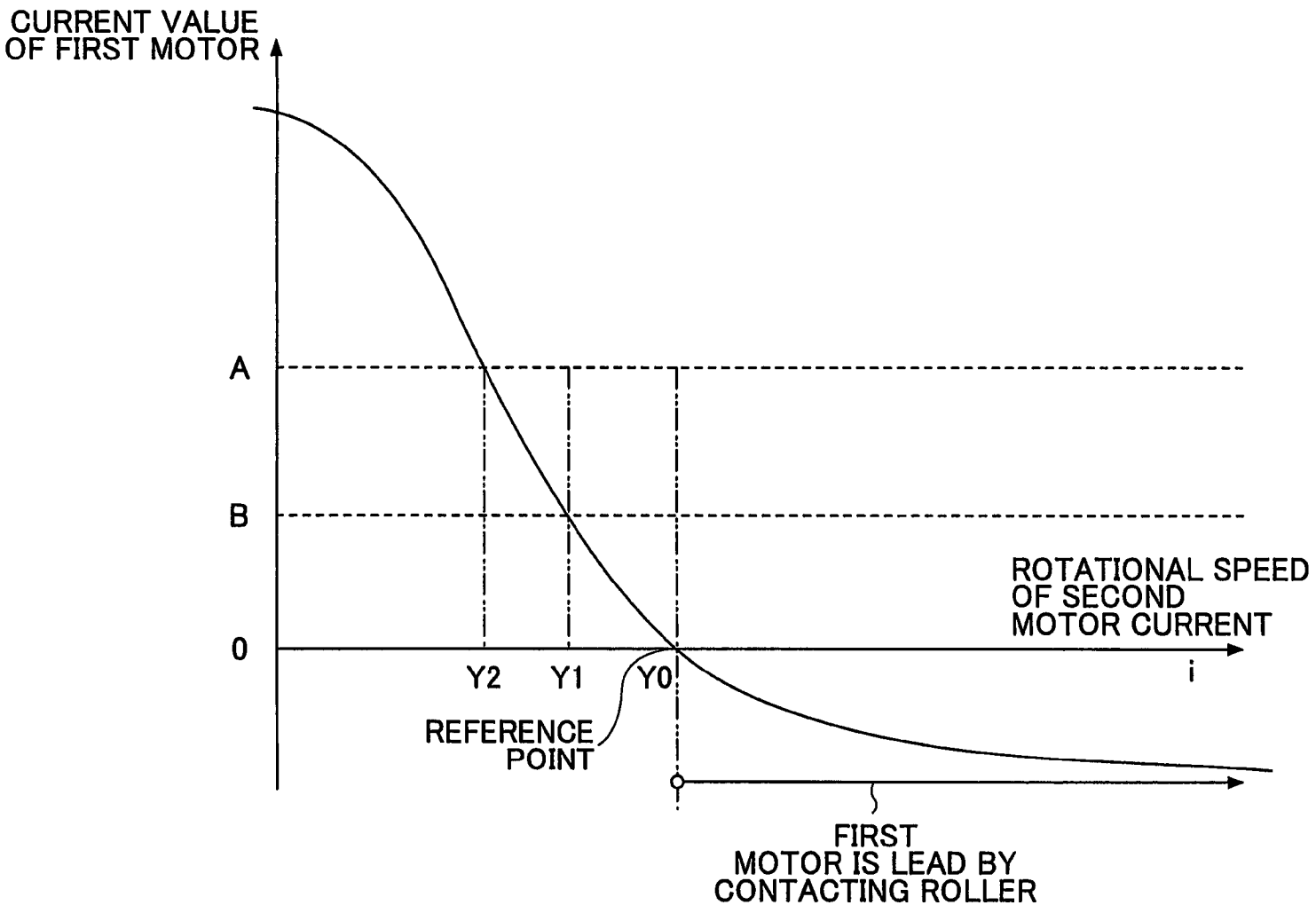
FIG. 3 is a graph for illustrating a relationship between a rotational speed of the second motor and a current value of the first motor.

FIG. 3 is a graph for illustrating a change of the driving current value of the first motor 3 when the rotational speed of the second motor 5 is changed by changing the driving current value of the second motor 5 while controlling the driving current of the first motor 3 to be a predetermined rotational speed. Referring to FIG. 3, when the driving current value is gradually increased from a state in which the secondary transferring roller 6 is led by the intermediate transferring medium 1 to a state in which the rotational speed of the second motor 5 is increased while rotating the intermediate transferring medium 1 at a predetermined rotational speed, a load of leading the contacting roller 6 with the intermediate transferring medium 1 is relaxed to thereby gradually reduce the driving current of the first motor 3.

By further increasing the rotational speed of the second motor 5, the surface speed of the contacting roller 6 is caused to be faster than the surface speed of the intermediate transferring medium 1. Then, the intermediate transferring medium 1 is led by the contacting roller 6 and the surface speed of the intermediate transferring medium 1 starts to increase. In this case, it becomes impossible to control the rotational speed of the first motor 3 even though the driving current value of the first motor 3 is turned off to zero because the first motor 3 is being led at a rotational speed of the target rotational speed or more. At this time, it may be observed by measuring the driving current value of the first motor 3 that the first motor 3 generates a negative driving current.

The intermediate transferring device of Embodiment 1 provides a transferring device which transfers a toner image in a photoreceptor of a full color image forming apparatus as illustrated in FIG. 1. In Embodiment 1, the load indicating value is set to the electric current value of the first motor. The rotational speed of the second motor is maintained within a predetermined range of the target rotational speed by controlling the electric current value of the first motor within a predetermined range.

Figure 4:
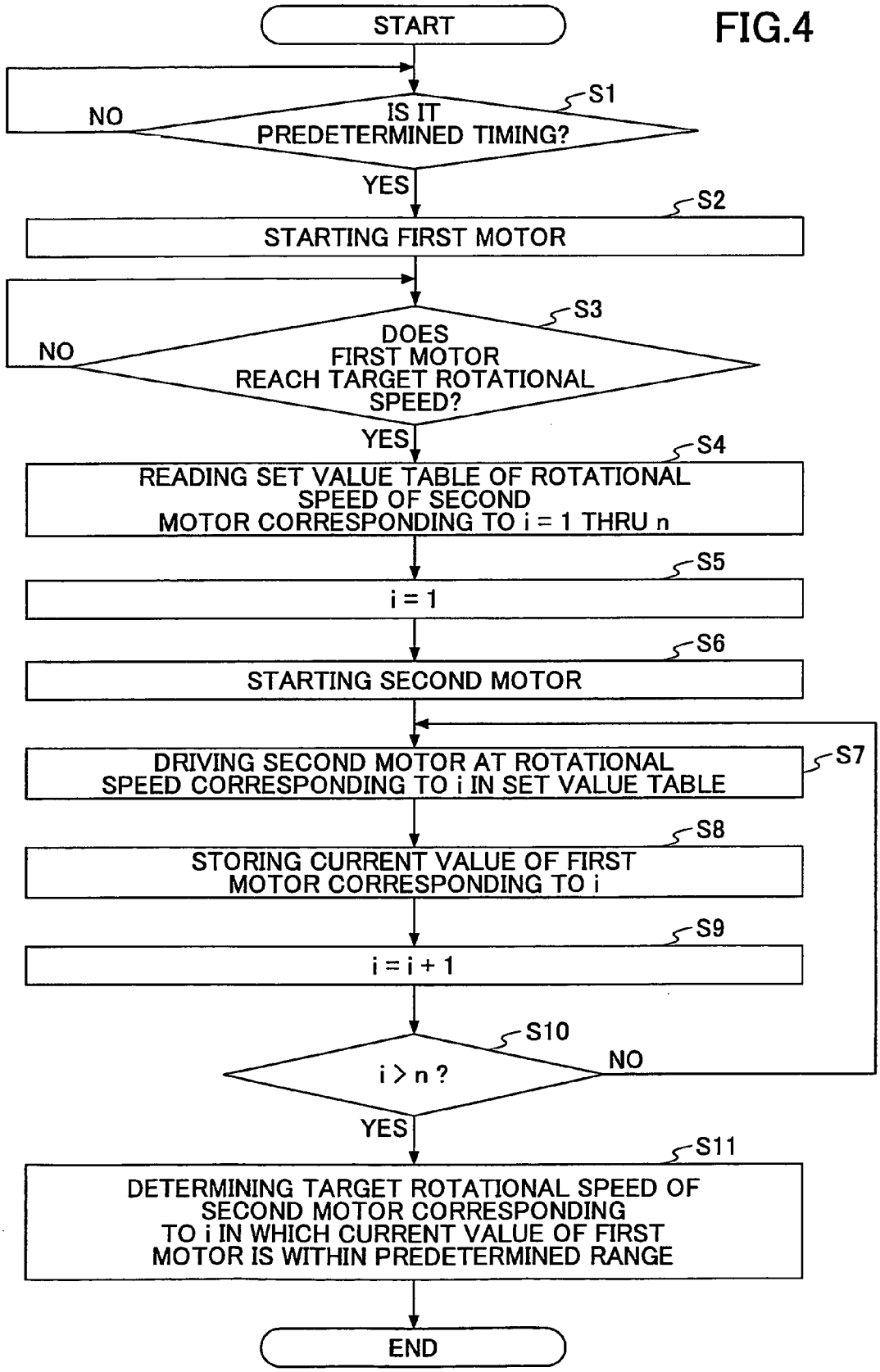
FIG. 4 is a flowchart (1) of a setup procedure of a target rotational speed of the second motor.

FIG. 4 is a flowchart (1) of a setup procedure of a target rotational speed of the second motor. Referring to FIG. 4, the setup procedure of the target rotational speed is described next. When the motor control unit 7 starts to carry out the setup flow of the target rotational speed of the second motor 5, the motor control unit 7 determines whether it is a timing for setting the target rotational speed of the second motor in step S1. For example, when image transfer is stopped, it is the predetermined timing. If it is YES in step S1, the second motor 3 is started in step S2.

The motor control unit 7 controls the first motor 3 to rotate at the target rotational speed so that the surface speed of the intermediate transferring medium 1 has a predetermined speed used for ordinary image forming. When the first motor 3 reaches the target rotational speed, the first motor 3 is controlled to rotate at the target rotational speed constantly in step S3. Then, variations of transmission speeds are rarely generated in a driving force transmission mechanism between the first motor 3 and the driving roller 4 and a driving force transmission mechanism between the driving roller 4 and the intermediate transferring medium 1 due to slip or the like.

A set value table, which determines rotational speeds of the second motor 5 using set values i (i=1 to n) up to as many as an arbitrary maximum number of n, is stored in a memory 23 or a memory unit included in the main control unit 21 in advance. The set values i are used to rotate the second motor 5 by the motor control unit 7.

When the first motor 3 reaches the target rotational speed, the motor control unit 7 reads the set value table from the memory 23 or the memory unit included in the main control unit 21 in step S4. The rotational speeds of the second motor 5 determined in the set value table may include a rotational speed of the second motor 5 which is led via the contacting roller 6 by the intermediate transferring medium 1 rotating at the predetermined rotational speed when the driving power of the second motor 5 is turned off. Further, the rotational speeds of the second motor 5 determined in the set value table may include a rotational speed slightly slower than a rotational speed at which the second motor 5 leads the first motor 3 via the contacting roller 6 and the intermediate transferring medium 1 after the second motor increases the rotational speed of the second motor. The rotational speed of the second motor 5 is preferably increased or decreased in the order from i=1 to i=n.

The motor control unit 7 may include a load indicating value measuring unit 7*a* for measuring load indicating values of at least one of the first motor or the second motor.

The load indicating value measuring unit 7*a* controls the first motor 3 to rotate the intermediate transferring medium 1 at a predetermined surface speed while transferring of toner images to the recording media is stopped. Then, it is possible to form a profile of load indicating values of at least one of the first motor 3 or the second motor 5 in association with the rotational speeds of the second motor 5, which are changed by changing electric current values of the second motor 5.

The motor control unit 7 determines i as being i=1 in step S5, and causes the second motor 5 to start in step S6. Then, the motor control unit 7 controls the second motor 5 so that the second motor 5 rotates at a rotational speed corresponding to i=1 in step S7. Then, the load indicating value measuring unit 7*a* of the motor control unit 7 reads an electric current value of the first motor 3, and stores the electric current value, in association with i=1, in the memory 23 or the memory unit included in the main control unit 21 in step S8.

Next, the motor control unit 7 adds 1 to i to render i=i+1 in step S9. Then, it is confirmed that a relationship of i>n is not satisfied. If it is NO in step S10, the process returns to step S7. Then, a set value of the rotational speed of the second motor 5, the set value corresponding to the new i is read from the set value table of the rotational speed in step S4. The second motor 5 is controlled at the rotational speed corresponding to the new i in step S7. Then, the electric current value of the first motor 3 is read and stored in the memory 23 or the memory unit included in the main control unit 21 in step S8 in order to be associated with i.

In a manner similar to the above, the motor control unit 7 repeats steps S7 to S10 until the relationship of i>n is satisfied (as long as the result of step S10 is NO). When the relationship of i>n is satisfied in YES of step S10, reading of the electric current values and storing these in the memory 23 or the memory unit included in the main control unit 21 are finished. As a result, a profile of the electric current values of the first motor 3 in association with the rotational speeds of the second motor 5 is formed and stored in the memory 23 or the memory unit included in the main control unit 21. This profile corresponds to a graph of the electric current values of the first motor 3 with respect to the second motor 5 illustrated in FIG. 3.

After the motor control unit 7 forms the profile, the motor control unit 7 selects the set value i of the rotational speed of the second motor, which is associated with the electric current value of the first motor stored in the memory 23 or the memory unit included in the main control unit 21.

Referring to FIG. 3, an electric current value B of the first motor existing within a predetermined range and slightly larger than zero is used', for example. Then, the rotational speed Y1 of the second motor corresponding to the electric current value B of the first motor is determined as the set value i in the set value table. Thus, the rotational speed Y1 of the second motor is determined as the target rotational speed for the second motor 5 in step S11.

The driving current may be constantly supplied even when a certain level of load variations of the first motor 3 occurs within the predetermined range. The predetermined range of the electric current value of the first motor 3 is preferably as small as possible. When the electric current value of the first motor 3 exceeds the electric current value A illustrated in FIG. 3, the contacting roller 6 is greatly led by the intermediate transferring medium 1 to thereby reduce the driving force of the second motor 5. In this case, recording media such as recording papers may not be delicately and accurately controlled.

A reference point detecting unit included in the main control unit 21 or the motor control unit 7 detects a reference point when the surface speed exceeds a predetermined value, e.g. a target surface speed of the second motor 5, from the profile. The target rotational speed of the second motor 5 may be determined based on the reference point by a setting unit included in the main control unit 21 or the motor control unit 7.

Referring to FIG. 3, the reference point may be Y0, in which an electric load to the first motor 3 becomes nothing, and the load current of the first motor 3 is zero, for example.

While the toner images are transferred to the recording media, the rotational speed of the first motor 3 is controlled to make the surface speed of the intermediate transferring medium 1 the predetermined value, and the rotational speed of the second motor 5 is controlled to be the target rotational speed.

When the surface speed of the intermediate transferring medium 1 exceeds the predetermined value, the rotational speed of the first motor 3 is beyond control of the first motor 3 because driving force of the first motor 3 is not effective to the intermediate transferring medium 1. In this state, the intermediate transferring medium is started to be led by the contacting roller 6 and trailing the contacting roller 6.

In determining the target rotational speed of the second motor 5, the following may be considered. If the predetermined range of the driving current value of the first motor 3 is too close to zero, the rotational speed of the intermediate transferring medium 1 becomes substantially uncontrollable. When the predetermined range of the driving current value of the first motor 3 is too large, the intermediate transferring medium 1 leads the contacting roller 6, and the contacting roller 6 trails the intermediate transferring medium 1. Then, a rotational load of the contacting roller 6 is undertaken by the first motor 3. Then, loads to the first motor 3 and the second motor 5 greatly differ. Further, the driving force of the second motor 5 is reduced. Then, the driving current value becomes approximately zero to thereby cause unstable control.

On the other hand, the surface speed of the contacting roller 6 may be increased even though the rotational speed of the contacting roller 6 remains the same due to expansion of the contacting roller 6, which may be caused by running conditions such as a prolonged operation. For example, when the electric current value of the first motor 3 is set too small, the surface speed of the contacting roller 6 may exceed a normal surface speed of the intermediate transferring medium 1 even though the rotational speed of the second motor is maintained to be Y1. Then, the intermediate transferring medium 1 is led by the contacting roller 6 and the rotational speed and the surface speed of the intermediate transferring medium 1 become unstable. When the rotational speed of the intermediate transferring medium 1 becomes unstable, an image formed by using the surface of the intermediate transferring medium 1 is affected by the unstable rotational speed.

Specifically, the sizes of the contacting roller 6 and the intermediate transferring medium 1 may change due to change of circumstance or continuous longtime operation. Especially, under severe conditions, it is prominent. For example, when thousands of sheets are continuously printed, the contacting roller (secondary transferring roller) 6 may be subjected to thermal expansion to thereby increase surface speeds of the contacting roller 6 and the intermediate transferring medium 1. In this case, it is preferable to temporarily stop printing, and set driving conditions for the expanded secondary transferring roller or contacting roller.

In Embodiment 1, the second motor 5 is controlled so that the electric current value of the first motor 3 is set within the predetermined range and the second motor 5 is rotated at the target rotational speed Y1. The second motor 5 may be controlled using the driving current value or a PWM indicating value of the second motor 5. The predetermined range of the electric current values of the first motor 3 may be A thru B in FIG. 3. The target rotational speed of the second motor may be Y1 thru Y2 corresponding to the electric current values A thru B of the first motor 3.

Figure 5:
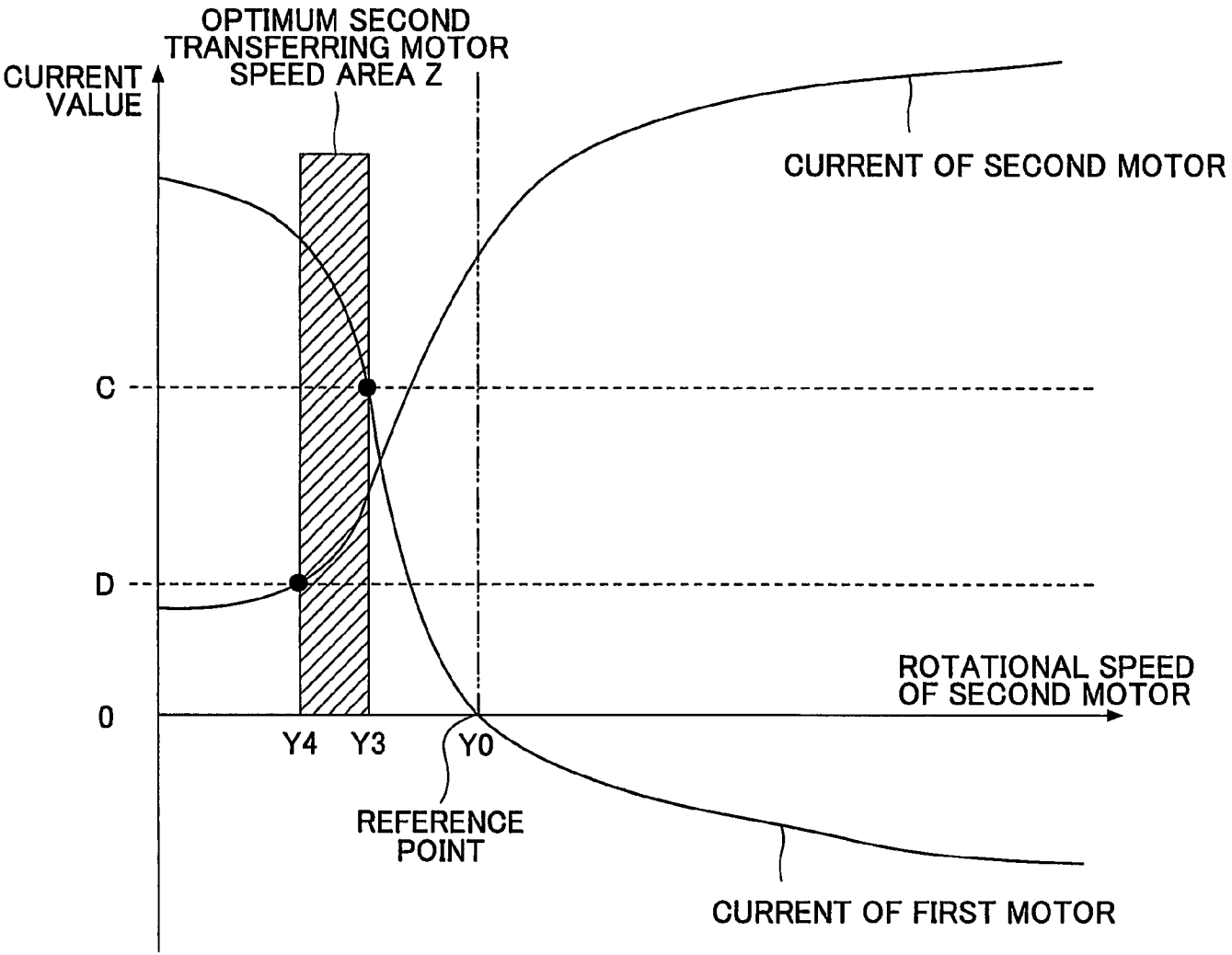
FIG. 5 is a graph for illustrating a relationship between electric currents of the primary and second motors with respect to the rotational speed of the second motor.

FIG. 5 is a graph for illustrating a relationship between electric currents of the first motor 3 and the second motor 5 when the rotational speed of the second motor 5 is changed by controlling the driving current of the first motor 3 so that the rotational speed of the intermediate transferring medium 1 becomes a predetermined speed ordinarily required for forming an image. Referring to FIG. 5, the profile of the driving current value of the first motor 3 is similar to that in FIG. 3. The driving current value of the second motor 5 increases as the rotational speed of the second motor 5 is increased. In order to make the rotational speed of the intermediate transferring medium 1 the predetermined value, the driving current value is controlled as illustrated in FIG. 5. When the rotational speed of the second motor 5 becomes larger than Y0 when the driving current value of the first motor 3 is zero, the intermediate transferring medium 1 is led by the second motor 5 via the contacting roller 6. Then, it becomes impossible to control the rotational speed of the first motor 3.

The driving current value of the first motor 3 may be controlled to be a predetermined value C or more and the driving current value of the second motor may be controlled to be a predetermined value D or more in conformity with the profile of the driving current value illustrated in FIG. 5. It is empirically known that the rotational speed of the intermediate transferring medium 1 may be stabilized at the above control. Then, the driving current value of the first motor 3 may be controlled to be within a relatively narrow range corresponding to the rotational speeds between Y3 and Y4 of the second motor 5. The rotational speed range of the second motor 5 illustrated in FIG. 5 is controlled within an optimum second motor speed area Z. The rotational speed Y3 of the second motor 5 is preferably a rotational speed slightly lower than the rotational speed of Y0, which corresponds to the driving current of the first motor of zero in a manner similar to Y1 in FIG. 3, considering a safety margin for error. Thus, the rotational speed of the intermediate transferring medium 1 is stabilized.

Figure 6:
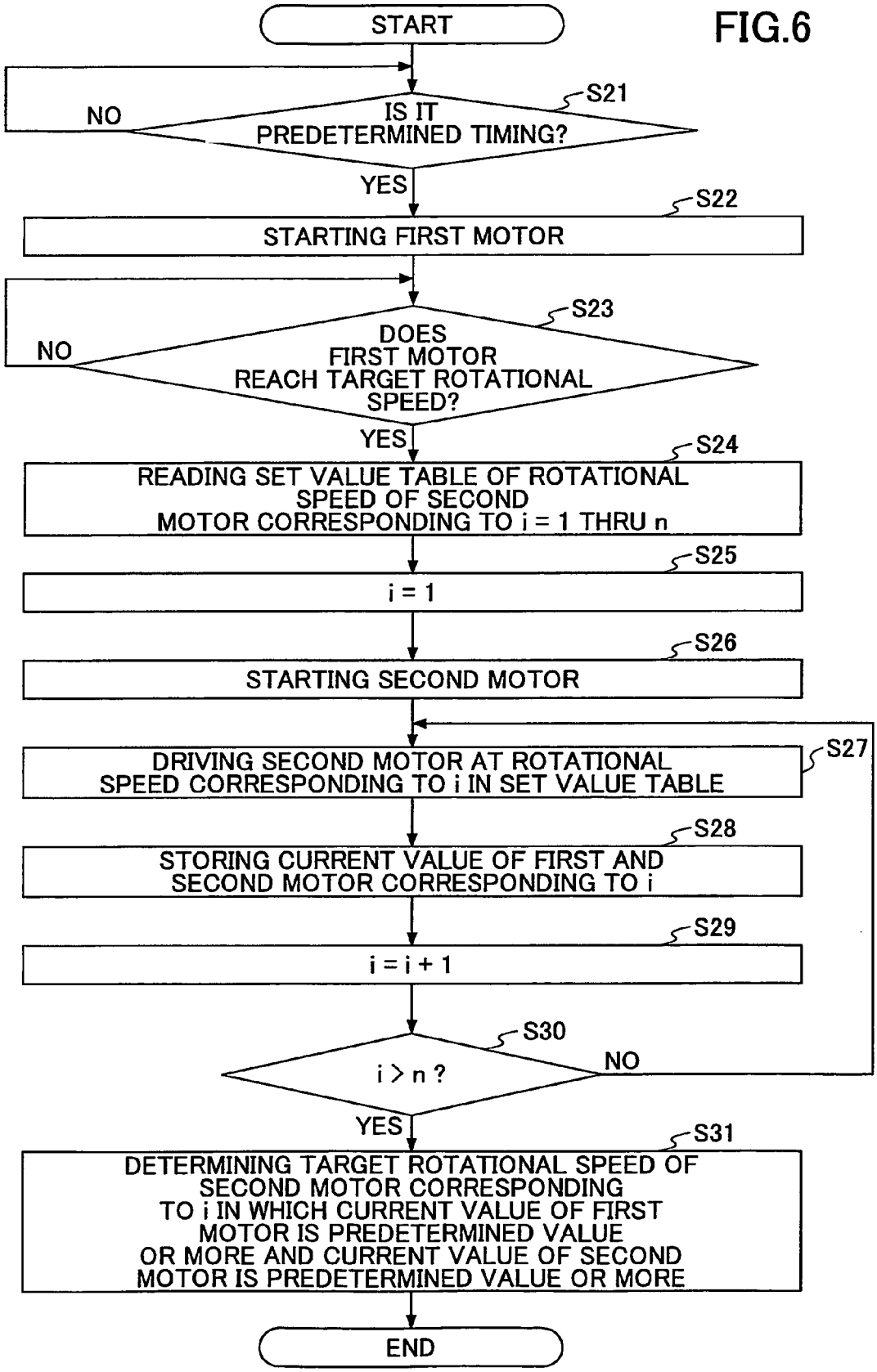
FIG. 6 is a flowchart (2) of a setup procedure of a target rotational speed of the second motor.

FIG. 6 is a flowchart (2) of a setup procedure of a target rotational speed of the second motor of Embodiment 2. Referring to FIG. 6, the setup procedure of the target rotational speed of Embodiment 2 is described next.

Referring to FIG. 6, step S21 thru YES of step S30 are substantially the same as step S1 thru YES of step S10 illustrated in FIG. 4. Referring to FIG. 6, step S21 thru YES of step S30 are substantially the same as step S1 thru YES of step S10 illustrated in FIG. 4. Therefore, only different points are described next. In step S28 corresponding to step S8 of Embodiment 1, the driving current value of the first motor 3 is stored in the memory 23 or the memory unit included in the main control unit 21 in addition to the driving current of the second motor 5. The motor control unit 7 stores a relationship between the driving current values of the first motor 3 and the second motor 5 with respect to set values of the rotational speeds of the second motor 5 determined in association with the set values i (i=1 to n) up to as many as the arbitrary maximum number of n.

If a relationship of i>n is satisfied along YES of step S30, a rotational speed causing a driving value of the first motor 3 to become a first predetermined value C or more and causing the driving current value of the second motor 5 to become a second predetermined value D or more within the optimum second motor speed area Z of the second motor 5 is set to a target rotational speed. At this time, the relationship between the driving current values of the first motor 3 and the second motor 5 is used. Thus, the driving current value of the second motor 5 is controlled in association with the driving current value of the first motor 3. A predetermined value C of the driving current value of the first motor 3 is set in a manner similar to that for the driving current value A of the first motor 3 of Embodiment 1. Further, a predetermined value D of the driving current value of the second motor 5 may be determined so as to correspond to a rotational speed Y4, which is smaller than the target rotational speed Y3 of the second motor 5 by the width of the optimum second motor speed area Z.

Specifically, when the first predetermined value is too small, the surface speed of the contacting roller 6 increases even though the rotational speed of the contacting roller 6 remains unchanged. Then, the intermediate transferring medium belt 1 is apt to be led to cause variations at an ordinary transferring speed of toner images.

When the first predetermined value C is too large, the contacting roller 6 may be led by the intermediate transferring medium 1. Then, a rotational load of the contacting roller 6 is applied to the first motor 3. Then, the loads to the first motor 3 and the second motor 5 greatly differ. The required driving force of the second motor 5 becomes less, and the driving force of the second motor 5 becomes approximately zero to thereby cause unstable control.

Specifically, the secondary predetermined value D is determined relative to the first predetermined value C. The secondary predetermined value D is preferably determined so that the intermediate transferring medium 1 does not lead the secondary transferring roller 5.

With the control, it is possible to control the driving current value of the second motor 5 to be the predetermined value or more while constantly maintaining the driving current value of the first motor 3 to be in a range of positive values, in which the rotational speed of the first motor 3 can be controlled to be the predetermined value. Thus, the rotational speed of the first motor 3 may be controlled by adjusting the driving current of the first motor 3 while the driving current value and the rotational speed respectively of the second motor 5 are measured and controlled.

Figure 7:
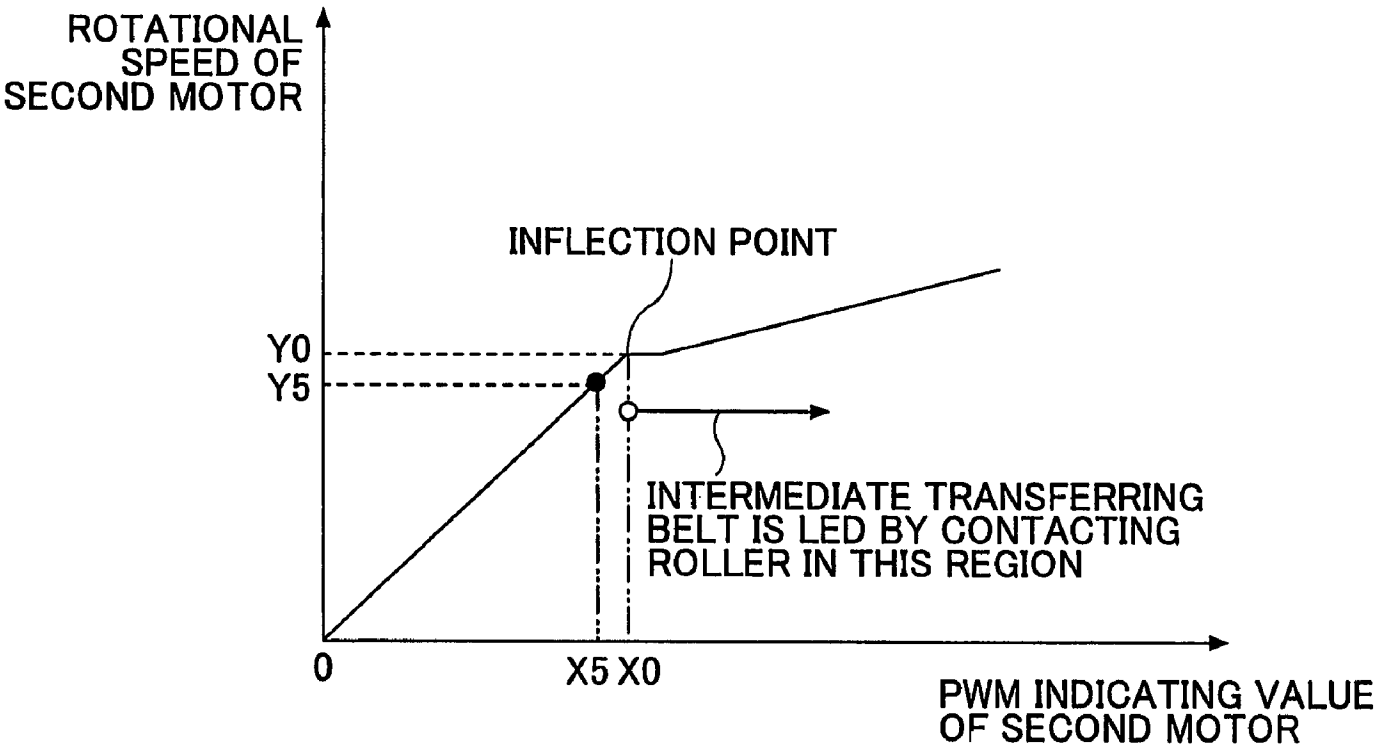
FIG. 7 is a graph illustrating a relationship between a PWM indication value of the second motor and a rotational speed of the first motor.

FIG. 7 is a graph illustrating a relationship between a PWM indicating value of the second motor and a rotational speed of the first motor 5 when driving electric power of the second motor 5 is controlled by the PWM indicating value. The PWM indicating value designates an indicating value used for controlling a load with pulse width modulation. When the PWM indicating value for the second motor 5 is increased and the driving electric power of the first motor 3 is controlled so as to constantly maintain the rotational speed of the first motor 3, the rotational speed of the second motor 5 becomes as illustrated in FIG. 7. When the PWM indicating value of the second motor 5 is small, the second motor 5 rotates to be led by the intermediate transferring medium 1. The PWM indicating value of the second motor 5 increases linearly along with increment of the rotational speed. However, an increasing rate of the rotational speed relative to increment of the PWM indicating value of the second motor 5 decreases after entering into a region more than a PWM indicating value of X0 (hereinafter, referred to as an inflection point X0). In the region of the inflection point X0 or more, the led motor is adversely changed from the second motor 5 to the first motor 3. Namely, the first motor 3 is led by the second motor 5 via the intermediate transferring medium 1. In this state, the rotational speeds of the first motor 3 and the intermediate transferring medium 1 are uncontrollable even though the driving current of the first motor 3 can be controlled. Therefore, it is preferable to determine a rotational speed Y5 corresponding to a PWM indicating value of X5, which is slightly smaller than the inflection point X0 to the target rotational speed of the second motor 5, considering a margin for error.

Specifically, a predetermined range of the PWM indicating value preferably does not cause the intermediate transferring medium 1 to be led by the contacting roller 6, the surface speed of which is increased by the predetermined range of the PWM indicating value.

When the PWM indicating value is too small, the contacting roller 6 may be led by the intermediate transferring medium belt 1. Then, a rotational load of the contacting roller 6 is applied to the first motor 3. Then, the loads to the first motor 3 and the second motor 5 greatly differ. Then, the required driving force of the second motor 5 becomes less, and the driving force of the second motor 5 becomes approximately zero to thereby cause unstable control. Therefore, the PWM indicating value may be properly determined in consideration of the above.

FIG. 8 is a flowchart (3) of a setup procedure of a target rotational speed of the second motor of Embodiment 3. Referring to FIG. 8, the setup procedure of the target rotational speed of Embodiment 3 is described next. Referring to FIG. 8, step S41 thru YES of step S50 are substantially the same as step S1 thru YES of step S10 illustrated in FIG. 4. Therefore, description of these steps is omitted, and different steps are described next.

The process from start to step S43 is the same as a process from start to step S3. In step S44 corresponding to step S4 of Embodiment 1, a set value table of the PWM indicating value for the second motor 5 corresponding to i=1 thru n is read and stored in the memory 23 or the memory unit included in the main control unit 21. Steps S45 and S46 are the same as those in Embodiment 1. In step S47, the second motor 5 is rotated to reach the PWM indicating value corresponding to the set value i by referring to the set value table. Then, the rotational speed of the second motor 5 of the PWM indicating value corresponding to the set value i is stored in the memory 23 or the memory unit included in the main control unit 21. In a manner similar to that in Embodiment 1, a profile of a relationship between the PWM indicating value of the second motor 5 and the rotational speed is stored while increasing the set values i up to as many as n one by one. Then, data collection to the memory 23 or the memory unit included in the main control unit 21 ends at YES in step S50. The profile corresponds to a graph between the PWM indicating value of the second motor 5 and the rotational speed of the second motor 5 illustrated in FIG. 7.

In step S51, a portion corresponding to the inflection point X0 illustrated in FIG. 7 is found from the profile between the PWM indicating value for the second motor 5 and the rotational speed. The first motor 3 is started to be led by the second motor from the inflection point X0. Said differently, in the region in which the rotational speed of the second motor 5 is larger than Y0 corresponding to the PWM indicating value X0 at the inflection point, the first motor 3 is led by the driving force of the second motor 5. Therefore, the first motor 3 may not be controlled at the predetermined rotational speed. Therefore, a rotational speed Y5 slightly lower than the rotational speed Y0 is set to the target rotational speed in step S52.

By controlling the second motor 5 at the above target rotational speed, the first motor 3 and the intermediate transferring medium 1 may be controlled at the predetermined speed using a relatively small electric current. Therefore, there remains a margin of the electric current usable as the driving current values for the first motor 3 and the second motor 5. Therefore, the margin of the electric current is applied to the first motor 3 or the second motor to further control the rotational speeds as required.

Figure 9:
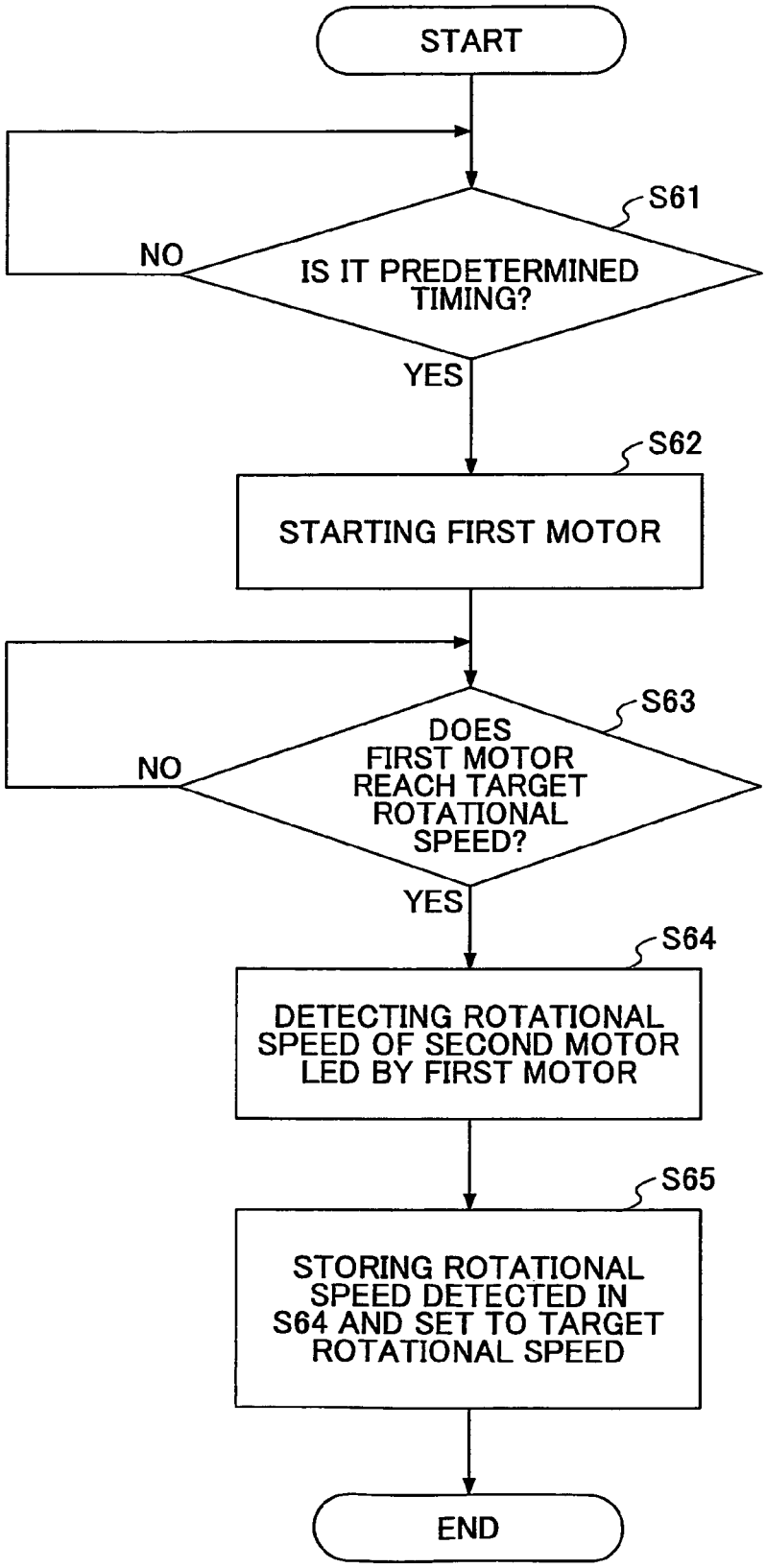
FIG. 9 is a flowchart (4) of a setup procedure of a target rotational speed of the second motor.

FIG. 9 is a flowchart (4) of a setup procedure of a target rotational speed of the second motor of Embodiment 4. The process from start to YES of step S63 is the same as the process from start to YES of step S3 of Embodiment 1 illustrated in FIG. 4. Therefore, the description thereof is omitted. When the first motor 3 is controlled to have the target rotational speed, the rotational speed of the second motor 5 which is led by the driving force of the first motor 3 via the intermediate transferring medium 1 is detected in step S64. The surface speed of the contacting roller 6, which is led by the intermediate transferring medium 1, is slightly slower than the surface speed of the intermediate transferring medium 1 due to slippage caused by leading and trailing. Therefore, the rotational speed of the second motor 5 detected in step S64 may be set to the target rotational speed of the second motor 5 in step S65. However, in order to give a sufficient margin with consideration for variability and load change, the target rotational speed of the second motor 5 may be a value slightly lower than the detected rotational speed of the second motor 5.

The target rotational speed of the second motor 5 may be effectively determined when a load (a carrying resistance) on the contacting roller 6 is small. When the load on the contacting roller 6 is excessively large, a large load may be applied to the first motor 3. Therefore, it is preferable to select one of the setup procedures of the target rotational speed of Embodiments 1 thru 3.

Figure 10:
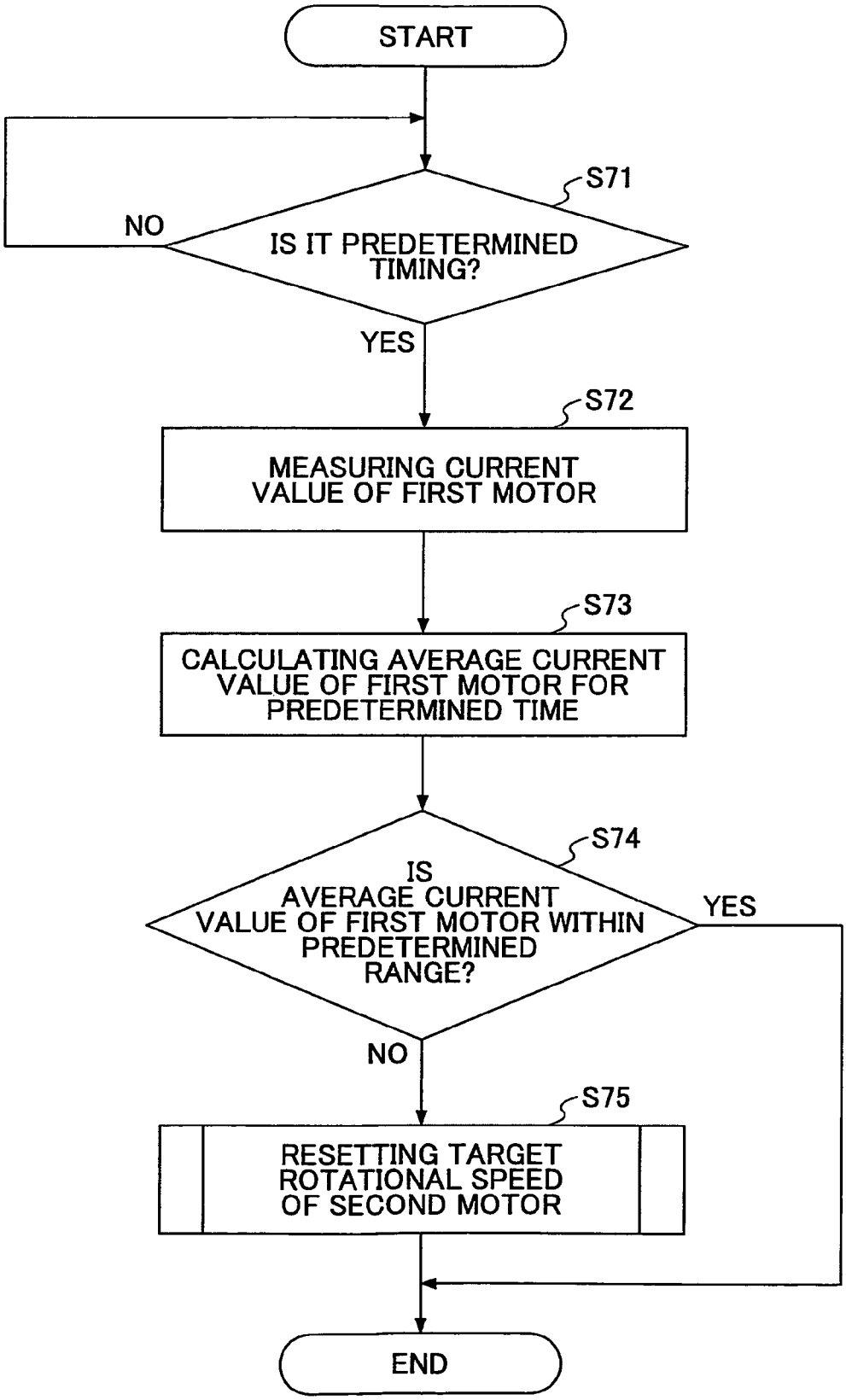
FIG. 10 is a flowchart (1) of a resetting procedure of a target rotational speed of the second motor while the second motor is being driven.

FIG. 10 is a flowchart (1) of a resetting procedure of a target rotational speed of the second motor of Embodiment 5 when the second motor is being driven. Then, even if the target rotational speed of the second motor is accurately controlled, the rotational speeds of the first motor 3 and the intermediate transferring medium 1 may not be controlled to be a predetermined value. Therefore, it is necessary to once stop the intermediate transferring device and reset the target rotational speed of the second motor. When the intermediate transferring device is continuously driven for a long term, a temperature around the contacting portion 9 may be increased. Then, the contacting roller 6 is heated to thereby increase its diameter. As a result, the surface speed of the contacting roller 6 becomes faster even though the contacting roller 6 is rotated at the same rotational speed. Further, the surface speed of the intermediate transferring medium 1 may possibly not be controlled even though the rotational speed of the second motor 5 rotated in association with the contacting roller 6 is controlled. Embodiment 5 is provided to detect the above state and reset the second motor 5 thereby ordinarily driving the intermediate transferring device using a revised target rotational speed.

Embodiment 5 is further described in reference to FIG. 10. When the resetting procedure of the target rotational speed of the second motor is started, the motor control unit 7 determines whether it is a predetermined timing in step S71. If it is YES in step S71, the electric current value of the first motor 3 is measured in step S72. The motor control unit 7 continues to measure the electric current of the first motor 3 for a predetermined period, and calculates an average electric current value of the first motor 3 in step S73. When the average electric current value is not in a predetermined range (ordinarily the predetermined value or less) in YES of step S74, the first motor is led due to a temporary load change. Thus, it is determined that the rotational speed may possibly not be controlled. When the average electric current value is not in the predetermined range, the intermediate transferring device temporarily stops its operation, and starts to reset the target rotational speed of the second motor using any one of the setup procedures of Embodiments 1 thru 4 in step S75. Thereafter, the intermediate transferring device controls the second motor 5 using the revised target rotational speed of the second motor. Then, the intermediate transferring device restarts its operation. In case of NO in step S74, the intermediate transferring device 12 is continuously operated as usual without providing any additional adjustment.

The above resetting procedure of the target rotational speed of the second motor enables an accurate rotational speed control of the first motor 3 depending on the operating conditions to further enable to control the rotational speed of the intermediate transferring medium 1. Furthermore, if the resetting procedure of the target rotational speed of the second motor is regularly or intermittently carried out, the rotational speed of the intermediate transferring medium 1 may be constantly and accurately controlled. Thus, it becomes possible to make the electric current value of the first motor 3, the PWM indicating value of the second motor and other values as close as possible to ideal values.

Figure 11:
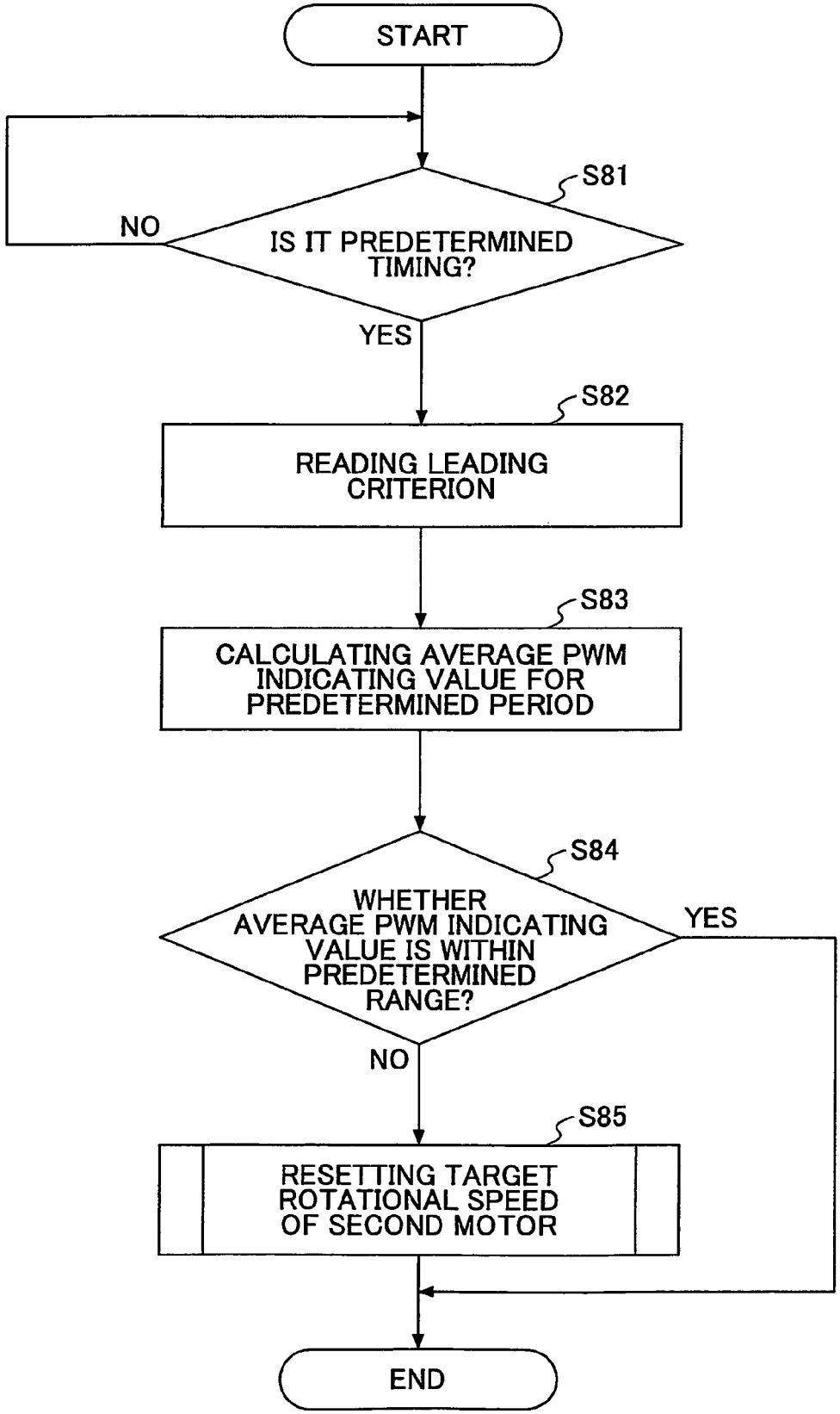
FIG. 11 is a flowchart (2) of a resetting procedure of a target rotational speed of the second motor while the second motor is being driven.

FIG. 11 is a flowchart (2) of a resetting procedure of a target rotational speed of the second motor of Embodiment 6 while the second motor is being driven. Embodiment 6 is a modified example of Embodiment 5. Referring to FIG. 11, the PWM indicating value is used to determine whether the target rotational speed is reset instead of the electric current value of the first motor 3 of Embodiment 5 illustrated in FIG. 10.

After starting a resetting procedure of the target rotational speed of the second motor, the motor control unit 7 determines that the intermediate transferring device is properly running without troubles in step S81. If it is YES in step S81 as being at a proper timing for resetting the target rotational speed, a leading and trailing criterion value such as the PWM indicating value is read from a memory unit installed in the main control unit 21 and stored in the control CPU 21 or 22 in step S82. The PWM indicating value of the first motor 3 is measured for a predetermined period, and an average PWM indicating value of the first motor 3 is calculated by the motor control unit 7 in step S83. When the average PWM indicating value of the first motor 3 departs from the leading and trailing criterion value (PWM indicating value) in NO of step 84, the motor control unit 7 determines that the first motor 3 may be led by the second motor 5 to thereby disable controlling the rotational speed of the intermediate transferring medium 1.

The target rotational speed of the second motor 5 is reset by the setup procedures of the target rotational speed of any one of Embodiments 1 thru 4. Thereafter, the intermediate transferring device controls the second motor 5 using the revised target rotational speed of the second motor. Then, the intermediate transferring device restarts its operation. In case of NO in step S84, the intermediate transferring device 12 is continuously operated as usual without providing any additional adjustment. In Embodiment 6, functions and effects similar to those in Embodiment 5 are obtainable.

Specifically, the setup procedures of the target rotational speed of any one of Embodiments 1 thru 4 are the setup procedure of the target speed using the electric current value of the first motor 3, the setup procedure of the target speed using the electric current values of the first motor 3 and the second motor 5, the setup procedure of the target speed using the average PWM indicating value of the second motor 5, and the setup procedure of the target speed using the speed under the leading and trailing relationship of the second motor 5.

Figure 12:
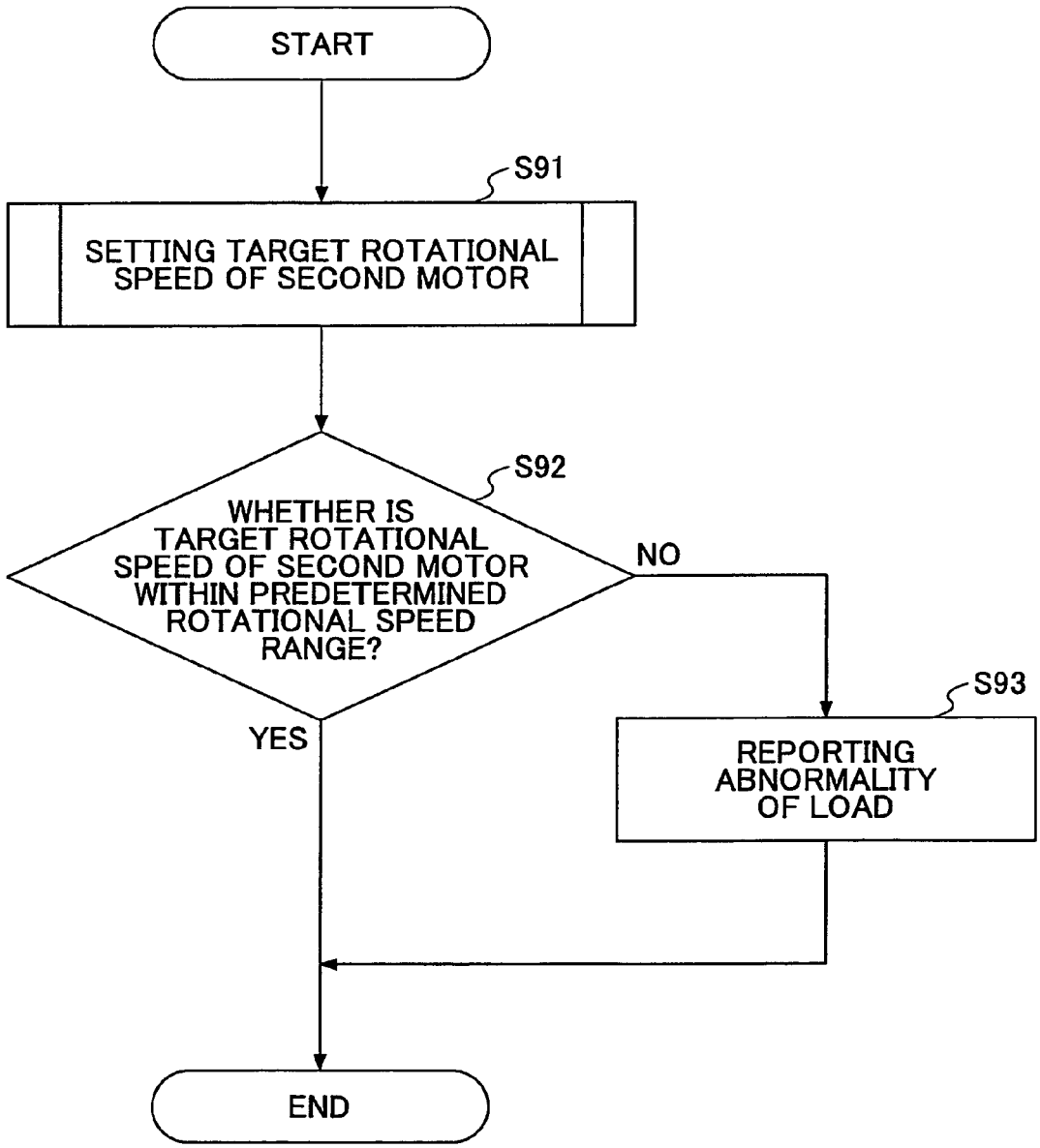
FIG. 12 is a flowchart of alarming abnormal load to the second motor.

FIG. 12 is a flowchart of alarming abnormal load to the second motor 5. Abnormality of the second motor 5 is detected when the target rotational speed of the second motor 5 is set by the setup procedures of the target rotational speed of Embodiments 1 thru 4 or when the target rotational speed of the second motor 5 is reset by the resetting procedure of the target rotational speed of Embodiments 5 and 6 in step S91. The motor control unit 7 determines whether the target rotational speed of the second motor 5 is within a predetermined range which is assured to be normal in step S92. When the target rotational speed departs from the predetermined range in no of step S92, loads to the first motor 3 and the second motor 5 may be normal. Therefore, the motor control unit 7 of the intermediate transferring device is controlled to rotate the second motor 5 at the set or reset target rotational speed.

When the target rotational speed departs from the predetermined range in no of step S92, the control CPU 22 of the motor control unit 7 reports the abnormality of the first motor 3 or the second motor 5 to the main control unit 21 in step S93.

The report is carried out by a sound alarm, a light alarm, a display on a display panel (not illustrated) of the operation unit 24, or any other alarming methods.

When the rotational speed of the first motor 3 is not within a predetermined range, abnormality of the first motor 3 may be reported from the control CPU 22 to the main control unit 21 in a manner similar to the above.

Figure 13:
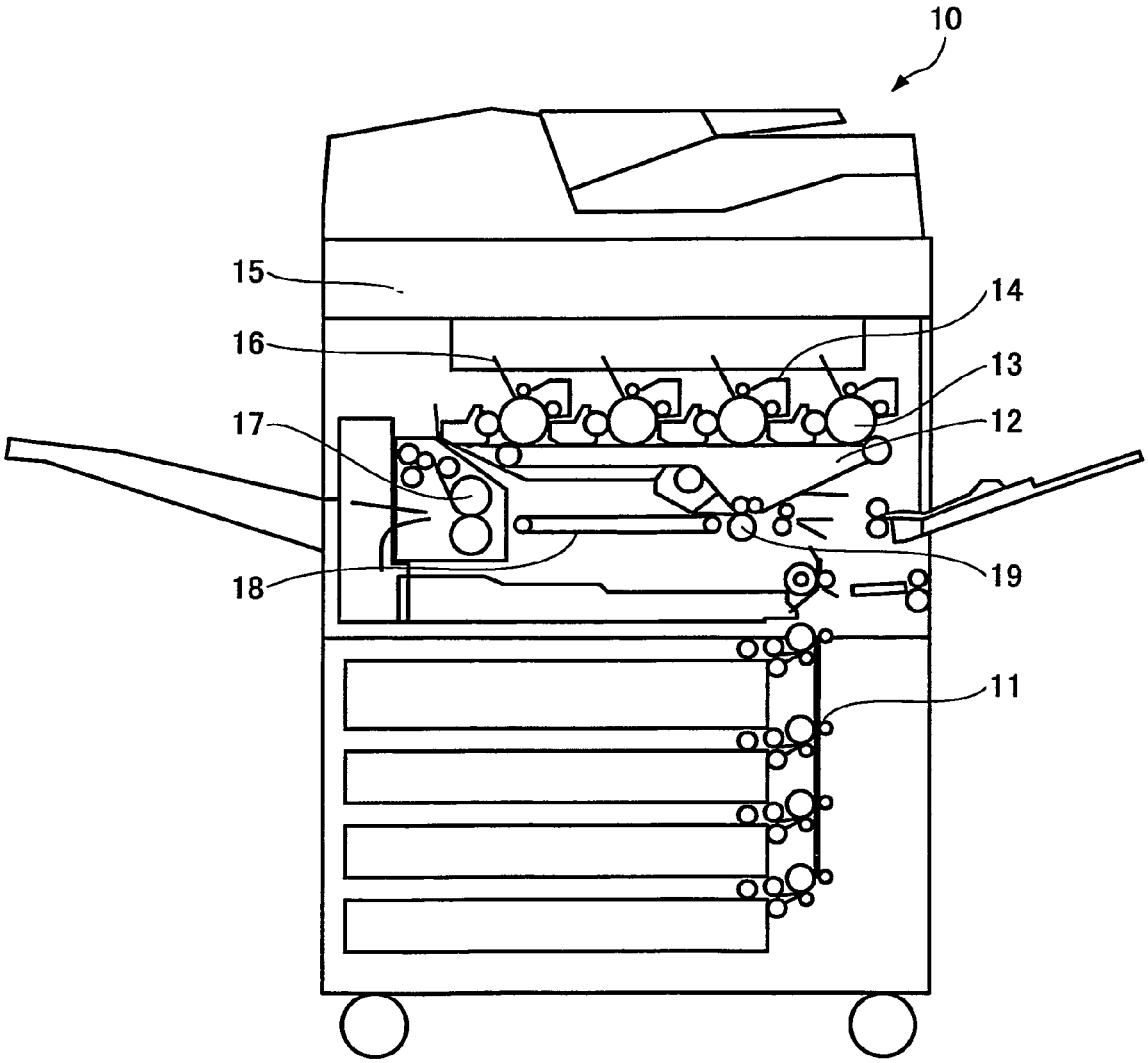
FIG. 13 is a schematic view of an image forming apparatus.

FIG. 13 is an image forming apparatus of Embodiment 7 of the present invention. The image forming apparatus 10 includes multi color processing units of an electrophotographic system, in which a charging unit 16 and an image developing unit 14 are provided around a photoreceptor 13. The multi color processing units charges the surface of the photoreceptors 13, forms electrostatic latent images using an optical image radiated from LED light sources or the like with an exposure unit 15, and forms toner images by applying toner to the electrostatic latent images. The toner images on the surfaces of the photoreceptors 13 are sequentially superposed and transferred to the intermediate transferring medium (an intermediate transferring medium) 1. Then, recording media (ordinarily recording papers) are carried by a contacting portion or a nipping portion (not illustrated). While the recording media are carried, multi color toner images are simultaneously transferred to the recording media as a color image. The recording media with the color image transferred from the intermediate transferring medium 12 is carried to a fixing device 17. The color images are fixed to the recording media by the fixing device 17. Thus, a full color image is formed.

The intermediate transferring device according to the present invention is applicable to not only intermediate transferring devices of image forming apparatuses but also various moving body controlling devices which carry sheet-like matters. The intermediate transferring device of the embodiments demonstrates excellent effects in carrying the recording media and transferring media. Especially, it is preferably used for full-color image forming apparatuses of a tandem electrophotographic system, and driving belts are used as image transferring media.

In embodiments of the present invention, a first moving body may be an intermediate transferring medium 1, a driving roller 4, a contacting roller 6 and a photoreceptor (image holding body) 13, configured to be rotated by a motor. Meanwhile, a second moving body affects the rotation of the first moving body. The second moving body may be at least one of the intermediate transferring medium 1, the driving roller 4, the contacting roller 6 and the photoreceptor (image holding body) 13, configured to be rotated by another motor. When two moving bodies affect each other by directly being in contact or interposing a paper or the like between these, at least one of the two moving bodies may be accurately controlled to move at a predetermined rotational, carrying speed or surface speed.

Examples of the first and second moving bodies are: the intermediate transferring medium 1 and the contacting roller 6; the driving roller 4 and the contacting roller 6; the intermediate transferring medium 1 and the photoreceptor (image holding body) 13; the driving roller 4 and the photoreceptor (image holding body) 13; the contacting roller 6 and the intermediate transferring medium 1; the contacting roller 6 and the driving roller 4; the photoreceptor (image holding body) 13 and the intermediate transferring medium 1; and the photoreceptor (image holding body) 13 and the driving roller 4.

The above and other modes of the embodiments of the present invention are as follows. The attached reference signs only designate typically corresponding parts or portions, and are not limiting any structure, configuration or the like of the present invention.

According to a first mode, there is provided a moving body controlling device 12 including a first moving body 1, 4 configured to be rotated by a first motor 3, a second moving body 6, 13 configured to affect movement of the first moving body 1, 4, a second motor 5 configured to rotate a second moving body 6, 13, a surface speed detecting unit 2 configured to detect a surface speed of the first moving body 1, 4, a first control unit 7 configured to control rotation of the first motor 3, a second control unit 7 configured to control rotation of the second motor 5, a memory unit 21, 7 configured to store a relationship between the rotational speed of the second motor 5 and an indicating value for driving at least one of the first motor 3 and the second motor 5 when the second control unit changes the rotational speed of the second motor 5 while the first control unit controls a rotational speed of the first motor 3 to cause the surface speed detected by the surface speed detecting unit 2 to be a predetermined speed, when the moving body controlling device is in a mode of setting a target rotational speed of the second motor 5, a reference point detecting unit 21, 7 configured to detect based on the relationship stored in the memory unit 21, 7 a reference point of the rotational speed of the second motor 5, at which the surface speed of the first moving body 1, 4 starts to exceed the predetermined speed, when the moving body controlling device is in the mode of setting the target rotational speed of the second motor 5, and a setting unit 21, 7 configured to set the target rotational speed of the second motor 5 based on the reference point detected by the reference point detecting unit 21, 7, when the moving body controlling device is in the mode of setting the target rotational speed of the second motor 5, wherein when the moving body controlling device is not in the mode of setting the target rotational speed of the second motor 5, the first control unit 7 controls the rotational speed of the first motor 3 to cause the surface speed detected by the surface speed detecting unit to be the predetermined speed, and the second control unit 7 controls the second motor 5 to rotate at the target rotational speed.

According to a second mode, there is provided the moving body controlling device, wherein the second motor 5 is controlled by the second control unit 7 using pulse width modulation, the indicating value is an indicating value of the pulse width modulation for driving the second motor 5, the reference point is an inflection point X0, Y0 of a graph illustrating the relationship, and the target rotational speed is set as a rotational speed of the second motor 3 corresponding to the indicating value of the pulse width modulation for driving the second motor 5 in a predetermined range smaller than an indicating value of the pulse width modulation at the inflection point.

According to a third mode, there is provided the moving body controlling device, wherein the indicating value is an electric current value for driving the first motor 3, the electric current value for driving the first motor 3 at the reference point Y0 is zero, and the target rotational speed is set as a rotational speed of the second motor in a predetermined range A, B in which the electric current value for driving the first motor is larger than zero in the relationship.

According to a fourth mode, there is provided the moving body controlling device, wherein the indicating value is an electric current value for driving the first motor 3 and an electric current value for driving the second motor 5, the electric current value for driving the first motor 3 at the reference point Y0 is zero, and the target rotational speed is set as a rotational speed of the second motor in a predetermined range A, B in which the electric current value for driving the first motor is equal to or larger than a first predetermined value larger than zero in the relationship, and the electric current value for driving the second motor is equal to or larger than a second predetermined value Y2, Y1 in the relationship.

According to a fifth mode, there is provided a moving body controlling device including a first moving body 1, 4 configured to be rotated by a first motor 3, a second moving body 6, 13 configured to affect movement of the first moving body 1, 4, a second motor 5 configured to rotate a second moving body 6, 13, a surface speed detecting unit 2 configured to detect a surface speed of the first moving body 1, 4, a first control unit 7 configured to control rotation of the first motor 3, a second control unit 7 configured to control rotation of the second motor 5, and a setting unit 21,7 configured to cause the first control unit 7 to control a rotational speed of the first motor 3 in order to make the surface speed detected by the surface speed detecting unit 2 to be a predetermined speed when the moving body controlling device is in the mode of setting a target rotational speed of the second motor, and to set a target rotational speed of the second motor 5 based on a rotational speed the second motor 5 when the second moving body 6, 13 is lead by the first moving body 1, 4 without supplying an electric current of driving the second motor when the moving body controlling device is in the mode of setting a target rotational speed of the second motor 5, wherein when the moving body controlling device is not in the mode of setting the target rotational speed of the second motor 5, the first control unit 7 controls the rotational speed of the first motor 3 to cause the surface speed detected by the surface speed detecting unit 2 to be the predetermined speed, and the second control unit 7 controls the second motor 5 to rotate at the target rotational speed.

According to a sixth mode, there is provided the moving body controlling device, wherein if the target rotational speed departs from a predetermined range, existence of an abnormality is determined and outwardly reported.

According to a seventh mode, there is provided an image forming apparatus 10 including an image holding body 13 holding a toner image, and an intermediate transferring device 12 including an intermediate transferring medium 1 configured to receive the toner image from the image holding body 13, and to be rotated by a first motor 3, a contact roller 6 configured to cause the toner image to transfer to a recording medium by interposing the recording medium at a contact portion between the contact roller 6 and the intermediate transferring medium 1, and to affect rotation of the intermediate transferring medium 1; a second motor configured to rotate the contact roller 6; a surface speed detecting unit 2 configured to detect a surface speed of the intermediate transferring medium 1; a first control unit 7 configured to control rotation of the first motor 3; a second control unit 7 configured to control rotation of the second motor 5; a memory unit configured to store a relationship between the rotational speed of the second motor 5 and an indicating value for driving at least one of the first motor 3 and the second motor 5 when the second control unit 7 changes the rotational speed of the second motor 5 while the first control unit 7 controls a rotational speed of the first motor 3 to cause the surface speed detected by the surface speed detecting unit 2 to be a predetermined speed, when the image forming apparatus 10 is in the mode of setting a target rotational speed of the second motor 5, the mode working only when the toner image is not transferred to the recording medium; a reference point detecting unit 21, 7 configured to detect based on the relationship stored in the memory unit a reference point of the rotational speed of the second motor 5 at which the surface speed of the intermediate transferring medium 1 starts to exceed the predetermined speed, when the image forming apparatus 10 is in a mode of setting the target rotational speed of the second motor 5; a setting unit 21, 7 configured to set the target rotational speed of the second motor 5 based on the reference point detected by the reference point detecting unit 21, 7, when the image forming apparatus 10 is in the mode of setting the target rotational speed of the second motor 5; wherein when the image forming apparatus 10 is not in the mode of setting the target rotational speed of the second motor 5, the first control unit 7 controls the rotational speed of the first motor 3 to cause the surface speed detected by the surface speed detecting unit 2 to be the predetermined speed, and the second control unit 7 controls the second motor 5 to rotate at the target rotational speed.

According to an eighth mode, there is provided the image forming apparatus 10 wherein the indicating value includes an electric current value for driving the first motor, when it is determined in the first control unit 7 that an average electric current value of the electric current values for driving the first motor becomes a predetermined electric current value or less, the toner image is prevented from being transferred to the recording medium, and the setting unit 21, 7 sets the target rotational speed of the second motor 5 again in the mode of setting the target rotational speed of the second motor 5.

When the present invention is applied to various moving body controlling devices which carry sheet-like matters, it is possible to carry the sheet-like matters while extremely accurately controlling the carrying speed of the sheet-like matters.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made thereto without departing from the spirit and scope of the invention.

This patent application is based on Japanese Priority Patent Application No. 2009-065670 filed on Mar. 18, 2009 and Japanese Priority Patent Application No. 2010-025772 filed on Feb. 8, 2010, the entire contents of which are hereby incorporated herein by reference.

What is claimed is:

1. A moving body controlling device comprising:

a first moving body configured to be rotated by a first motor;

a second moving body configured to affect movement of the first moving body;

a second motor configured to rotate a second moving body;

a surface speed detecting unit configured to detect a surface speed of the first moving body;

a first control unit configured to control rotation of the first motor;

a second control unit configured to control rotation of the second motor;

a memory unit configured to store a relationship between the rotational speed of the second motor and an indicating value for driving at least one of the first motor and the second motor when the second control unit changes the rotational speed of the second motor while the first control unit controls a rotational speed of the first motor to cause the surface speed detected by the surface speed detecting unit to be a predetermined speed, when the moving body controlling device is in a mode of setting a target rotational speed of the second motor;

a reference point detecting unit configured to detect based on the relationship stored in the memory unit a reference point of the rotational speed of the second motor, at which the surface speed of the first moving body starts to exceed the predetermined speed, when the moving body controlling device is in the mode of setting the target rotational speed of the second motor; and a setting unit configured to set the target rotational speed of the second motor based on the reference point detected by the reference point detecting unit, when the moving body controlling device is in the mode of setting the target rotational speed of the second motor, wherein when the moving body controlling device is not in the mode of setting the target rotational speed of the second motor, the first control unit controls the rotational speed of the first motor to cause the surface speed detected by the surface speed detecting unit to be the predetermined speed, and the second control unit controls the second motor to rotate at the target rotational speed.

2. The moving body controlling device according to claim 1, wherein the second motor is controlled by the second control unit using pulse width modulation, the indicating value is an indicating value of the pulse width modulation for driving the second motor, the reference point is an inflection point of a graph illustrating the relationship, and the target rotational speed is set as a rotational speed of the second motor corresponding to the indicating value of the pulse width modulation for driving the second motor in a predetermined range smaller than an indicating value of the pulse width modulation at the inflection point.

3. The moving body controlling device according to claim 1, wherein the indicating value is an electric current value for driving the first motor, the electric current value for driving the first motor at the reference point is zero, and the target rotational speed is set as a rotational speed of the second motor in a predetermined range in which the electric current value for driving the first motor is larger than zero in the relationship.

4. The moving body controlling device according to claim 1, wherein the indicating value is an electric current value for driving the first motor and an electric current value for driving the second motor, the electric current value for driving the first motor at the reference point is zero, and the target rotational speed is set as a rotational speed of the second motor in a predetermined range in which the electric current value for driving the first motor is equal to or larger than a first predetermined value larger than zero in the relationship, and the electric current value for driving the second motor is equal to or larger than a second predetermined value in the relationship.

5. A moving body controlling device comprising:

a first moving body configured to be rotated by a first motor;

a second moving body configured to affect movement of the first moving body;

a second motor configured to rotate a second moving body;

a surface speed detecting unit configured to detect a surface speed of the first moving body;

a first control unit configured to control rotation of the first motor;

a second control unit configured to control rotation of the second motor; and a setting unit configured to cause the first control unit to control a rotational speed of the first motor in order to make the surface speed detected by the surface speed detecting unit to be a predetermined speed when the moving body controlling device is in the mode of setting a target rotational speed of the second motor, and to set a target rotational speed of the second motor based on a rotational speed the second motor when the second moving body is lead by the first moving body without supplying an electric current of driving the second motor when the moving body controlling device is in the mode of setting a target rotational speed of the second motor, wherein when the moving body controlling device is not in the mode of setting the target rotational speed of the second motor, the first control unit controls the rotational speed of the first motor to cause the surface speed detected by the surface speed detecting unit to be the predetermined speed, and the second control unit controls the second motor to rotate at the target rotational speed.

6. The moving body controlling device according to claim 1, wherein if the target rotational speed departs from a predetermined range, existence of an abnormality is determined and outwardly reported.

7. An image forming apparatus comprising:

an image holding body holding a toner image; and an intermediate transferring device comprising:

an intermediate transferring medium configured to receive the toner image from the image holding body, and to be rotated by a first motor;

a contact roller configured to cause the toner image to transfer to a recording medium by interposing the recording medium at a contact portion between the contact roller and the intermediate transferring medium, and to affect rotation of the intermediate transferring medium;

a second motor configured to rotate the contact roller;

a surface speed detecting unit configured to detect a surface speed of the intermediate transferring medium;

a first control unit configured to control rotation of the first motor;

a second control unit configured to control rotation of the second motor;

a memory unit configured to store a relationship between the rotational speed of the second motor and an indicating value for driving at least one of the first motor and the second motor when the second control unit changes the rotational speed of the second motor while the first control unit controls a rotational speed of the first motor to cause the surface speed detected by the surface speed detecting unit to be a predetermined speed, when the image forming apparatus is in the mode of setting a target rotational speed of the second motor, the mode working only when the toner image is not transferred to the recording medium;

a reference point detecting unit configured to detect based on the relationship stored in the memory unit a reference point of the rotational speed of the second motor at which the surface speed of the intermediate transferring medium starts to exceed the predetermined speed, when the image forming apparatus is in a mode of setting the target rotational speed of the second motor;

a setting unit configured to set the target rotational speed of the second motor based on the reference point detected by the reference point detecting unit when the image forming apparatus 10 is in the mode of setting the target rotational speed of the second motor;

wherein when the image forming apparatus 10 is not in the mode of setting the target rotational speed of the second motor, the first control unit controls the rotational speed of the first motor to cause the surface speed detected by the surface speed detecting unit to be the predetermined speed, and the second control unit controls the second motor to rotate at the target rotational speed.

8. The image forming apparatus according to claim 7, wherein the indicating value includes an electric current value for driving the first motor, when it is determined in the first control unit that an average electric current value of the electric current values for driving the first motor becomes a predetermined electric current value or less, the toner image is prevented from being transferred to the recording medium, and the setting unit sets the target rotational speed of the second motor again in the mode of setting the target rotational speed of the second motor.

* * * * *